US011308968B2

(12) United States Patent
Suyama et al.

(10) Patent No.: US 11,308,968 B2
(45) Date of Patent: Apr. 19, 2022

(54) AUDIO SIGNAL OUTPUT DEVICE, AUDIO SYSTEM, AND AUDIO SIGNAL OUTPUT METHOD

(71) Applicant: Yamaha Corporation, Shizuoka (JP)

(72) Inventors: Akihiko Suyama, Shizuoka (JP); Ryotaro Aoki, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 16/951,934

(22) Filed: Nov. 18, 2020

(65) Prior Publication Data

US 2021/0174814 A1 Jun. 10, 2021

(30) Foreign Application Priority Data

Dec. 6, 2019 (JP) ..... JP2019-221387

(51) Int. Cl.
*G10L 19/008* (2013.01)

(52) U.S. Cl.
CPC ..... *G10L 19/008* (2013.01)

(58) Field of Classification Search
CPC ..... G10L 19/008; G10L 19/167; G10L 19/20; H04S 3/008; H04S 2420/03; H04S 2400/03; H04S 2400/01
USPC ..... 381/19, 22, 23, 307
See application file for complete search history.

(56) References Cited

U.S. PATENT DOCUMENTS 6,990,246 B1 * 1/2006 Ferguson ..... H04N 19/172 375/E7.037
7,272,556 B1 * 9/2007 Aguilar ..... G10L 19/093 704/201
2010/0118978 A1 * 5/2010 Rodriguez ..... H04N 19/587 375/240.26
2016/0088313 A1 * 3/2016 Fenney ..... H04N 19/192 382/234
2018/0220249 A1 * 8/2018 Aoki ..... H04R 27/00

FOREIGN PATENT DOCUMENTS

WO 2017164156 A1 9/2017

* cited by examiner

*Primary Examiner* — Alexander Krzystan
(74) *Attorney, Agent, or Firm* — Global IP Counselors, LLP

(57) ABSTRACT

An audio signal output device includes an audio signal acquisition unit configured to acquire audio signals of a plurality of channels, a first electronic controller, and an output unit. The first electronic controller includes a quantization bit expansion unit configured to expand the number of quantization bits of each of the audio signals to generate an expansion region for each of the audio signals, and an audio signal processing unit configured to generate an output signal in which the plurality of channels are downmixed such that an audio signal of at least one channel from among the plurality of channels is arranged at a reference bit position different from a reference bit position for an audio signal of a different channel of the plurality of channels, by using the expansion region. The output unit is configured to output the output signal.

16 Claims, 21 Drawing Sheets

AUDIO SIGNAL OUTPUT DEVICE, AUDIO SYSTEM, AND AUDIO SIGNAL OUTPUT METHOD

CROSS-REFERENCE TO RELATED APPLICATIONS

This application claims priority to Japanese Patent Application No. 2019-221387, filed on Dec. 6, 2019. The entire disclosure of Japanese Patent Application No. 2019-221387 is hereby incorporated herein by reference.

BACKGROUND

Technical Field

One embodiment of the present invention relates to a signal processing of audio signals.

Background Information

Conventionally, there have been signal processing devices that process music data signals received from smartphones and that transfer the processed signals to a transfer destination device (for example, refer to Patent Document 1). For example, a signal processing device of International publication No. 2017/164156 converts music data having 2.1 channels (L channel, R channel, and LEF channel) into music data that correspond to the capabilities of the transfer destination device, and transfers the converted data. For example, the signal processing device of International publication No. 2017/164156 increases the sampling frequency to secure empty areas between samples, and uses the secured empty areas to downmix and transfer signals of a plurality of channels. A receiving device of International publication No. 2017/164156 extracts a different channel signal every other sample.

SUMMARY

International publication No. 2017/164156 does not disclose a method for identifying channels. In the method of International publication No. 2017/164156, it is necessary to determine the channel of the first sample in advance, and to acquire the first sample in sequence. In the method of International publication No. 2017/164156, when the sample of the target channel does not always come first, it may not be possible to identify the channels.

An object of this disclosure is to output a signal with which the channels can be reliably identified.

An audio signal output device according to this disclosure includes an audio signal acquisition unit configured to acquire audio signals of a plurality of channels, a first electronic controller, and an output unit. The first electronic controller includes a quantization bit expansion unit configured to expand the number of quantization bits of each of the audio signals to generate an expansion region for each of the audio signals, and an audio signal processing unit configured to generate an output signal in which the plurality of channels are downmixed such that an audio signal of at least one channel from among the plurality of channels is arranged at a reference bit position different from a reference bit position for an audio signal of a different channel of the plurality of channels, by using the expansion region. The output unit is configured to output the output signal.

According to this disclosure, it is possible to output a signal with which the channels can be reliably identified.

DETAILED DESCRIPTION OF THE EMBODIMENTS

Selected embodiments will now be explained with reference to the drawings. It will be apparent to those skilled in the field from this disclosure that the following descriptions of the embodiments are provided for illustration only and not for the purpose of limiting the invention as defined by the appended claims and their equivalents.

Figure 1:
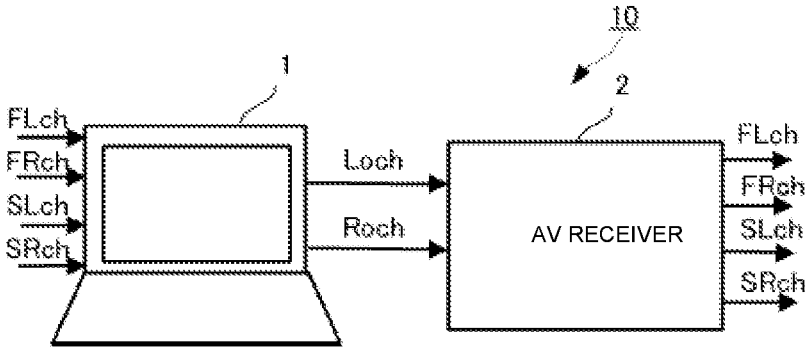
FIG. 1 is a block diagram illustrating the configuration of an audio system.

FIG. 1 is a block diagram illustrating the configuration of an audio system 10. As shown in FIG. 1, the audio system 10 uses a personal computer (hereinafter referred to as PC) 1 that acquires and processes audio signals and an AV receiver 2 that reproduces an output signal (audio signal) that is output from the PC 1. The PC 1 referred to in this example is one example of an audio signal output device according to this disclosure. The AV receiver 2 referred to in this example is one example of a reception device according to this disclosure.

The PC 1 acquires audio signals of an FL (Front Left) channel, an FR (Front Right) channel, an SL (Surround Left) channel, and an SR (Surround Right) channel (in the following description, the FL channel, FR channel, SL channel, and SR channel are collectively referred to as 4 channels; the FL channel, FR channel, SL channel, and SR channel are individually referred to as each channel) from a sound source (not shown). The PC 1 then signal-processes the acquired audio signals. At this time, the PC 1 downmixes the acquired 4-channel audio signals into two channels (Lo channel and Ro channel) and outputs the output signals of the Lo channel and the Ro channel to the AV receiver 2.

The sound source referred to in this example includes a mobile terminal such as a smartphone, a server, a music player, and the like. In addition, this example uses the FL channel, the FR channel, the SL channel, and the SR channel as examples, but the number and types of channels are not limited in this way. Moreover, this example uses the output signals of two channels as examples, but no particular limitation is thereby imposed.

Figure 2:
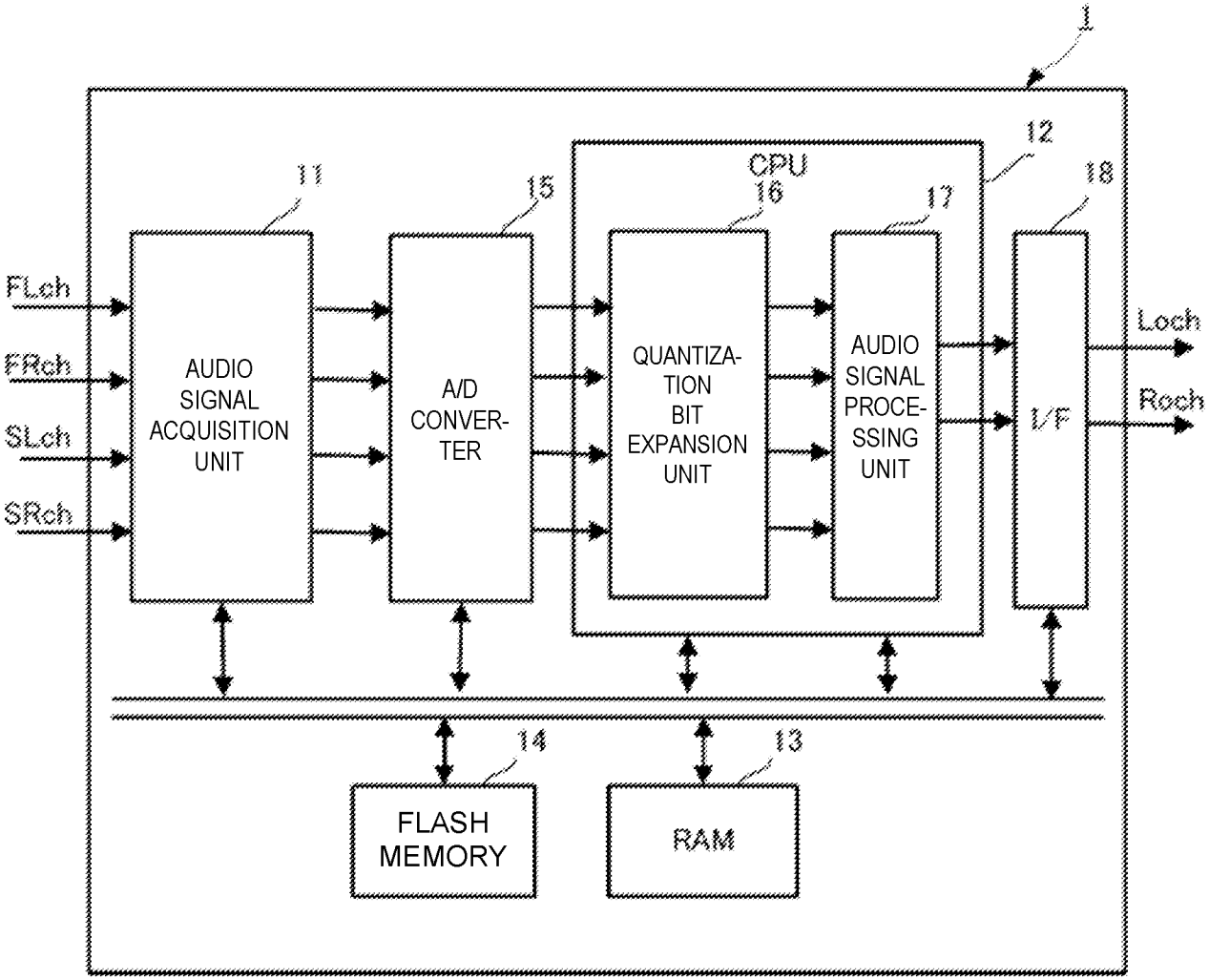
FIG. 2 is a block diagram illustrating the main configuration of a PC.

The PC 1 will be described with reference to FIG. 2. FIG. 2 is a block diagram illustrating the main configuration of the PC 1. As shown in FIG. 2, the PC 1 comprises an audio signal acquisition unit 11, at least one processor such as a CPU (Central Processing Unit) 12, a RAM (Random Access Memory) 13, a flash memory 14, an A/D (Analog to Digital) converter 15, and an interface (I/F) 18.

The CPU 12 corresponds to a first electronic controller and runs an operating OS and reads application programs stored into the flash memory 14 into the RAM 13 and integrally controls the PC 1. The term "electronic controller" as used herein refers to hardware that executes software programs.

Further, the CPU 12 includes a quantization bit expansion unit 16 and an audio signal processing unit 17. The CPU 12 reads a program from the flash memory 14 relating to a quantization bit expansion process, a program relating to audio signal processing, and the like, to the RAM 13 to constitute the quantization bit expansion unit 16 and the audio signal processing unit 17.

The audio signal acquisition unit 11 acquires, for example, a 4-channel audio signal (analog signals) from a sound source (not shown). The audio signal acquisition unit 11 can be an audio interface that includes an input port for inputting the audio signals from an external device into the PC1. The input port can be an analog input port or a digital input port. Alternatively, the audio signal acquisition unit 11 can be a wireless communication device such as a wireless module, which receives the audio signals from, for example, an external server that delivers the audio signals. The audio signal acquisition unit 11 outputs the acquired audio signals to the A/D converter 15. In the case that the audio signal acquisition unit 11 acquires digital audio signals from a sound source compliant with the S/PDIF (Sony Philips Digital InterFace) standard, for example, the A/D converter 15 is unnecessary.

Figure 3:
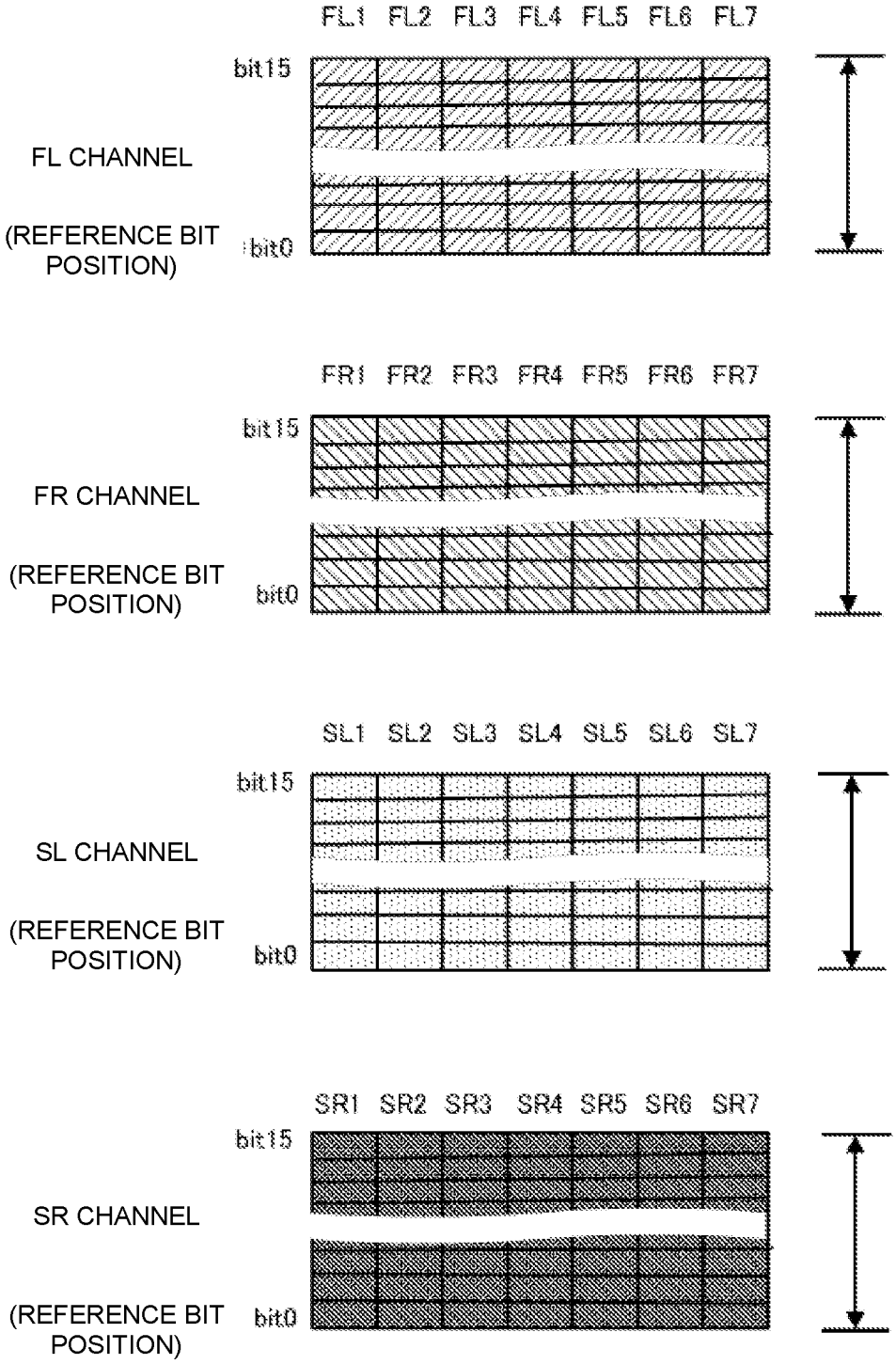
FIG. 3 is an explanatory diagram of an audio signal of an FL (Front Left) channel, an audio signal of an FR (Front Right) channel, an audio signal of an SL (Surround Left) channel, and an audio signal of an SR (Surround Right) channel.

FIG. 3 is an explanatory diagram of the audio signal of an FL channel, the audio signal of an FR channel, the audio signal of an SL channel, and the audio signal of an SR channel.

In FIG. 3, the horizontal axis of each channel represents samples (FL1-FL7, FR1-FR7, SL1-SL7, and SR1-SR7) time) and the vertical axis represents bits (volume).

When the audio signal acquisition unit 11 acquires an analog signal, the A/D converter 15 A/D-converts the analog signal into a digital signal. As shown in FIG. 3, the A/D converter 15 converts the analog signal into a digital audio signal with the number of quantization bits that is 16 bits (bit0-bit15). The A/D converter 15 outputs the converted digital audio signal to the quantization bit expansion unit 16. When the audio signal acquisition unit 11 acquires a digital audio signal, A/D conversion is not necessary. That is, the A/D converter 15 is not an essential component in this disclosure.

Figure 4:
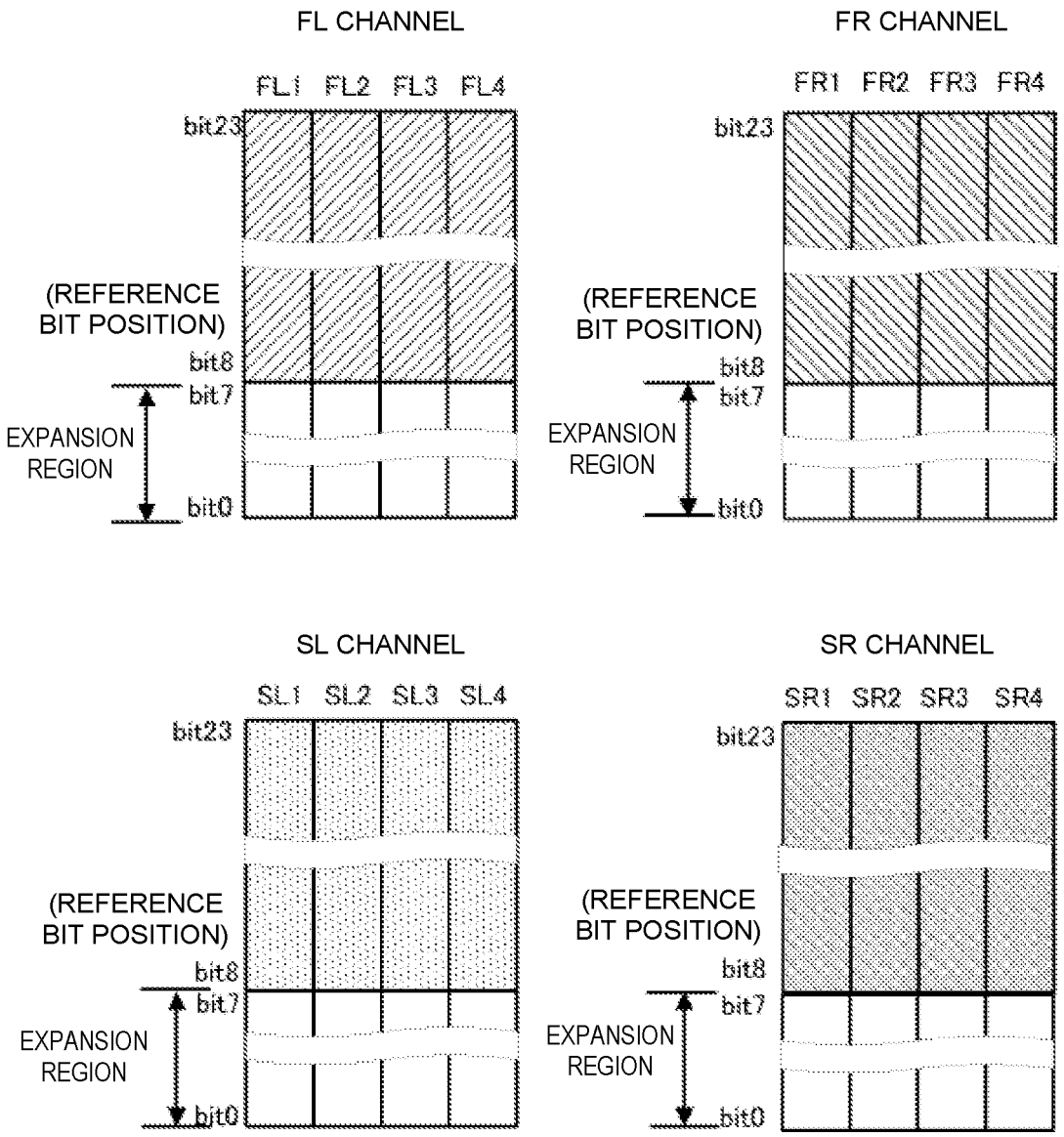
FIG. 4 is an explanatory diagram of an audio signal in which the number of quantization bits of the FL channel has been expanded, an audio signal in which the number of quantization bits of the audio signal of the FR channel has been expanded, an audio signal in which the number of quantization bits of the audio signal of the SL channel has been expanded, and an audio signal in which the number of quantization bits of the audio signal of the SR channel has been expanded.

FIG. 4 is an explanatory diagram of an audio signal in which the number of quantization bits of the audio signal of the FL channel has been expanded, an audio signal in which the number of quantization bits of the audio signal of the FR channel has been expanded, an audio signal in which the number of quantization bits of the audio signal of the SL channel has been expanded, and an audio signal in which the number of quantization bits of the audio signal of the SR channel has been expanded. In FIG. 4, the horizontal axis of each channel represents samples (time) and the vertical axis represents bits (volume).

The quantization bit expansion unit 16 expands the number of quantization bits of the audio signal of each of the four channels and generates expansion regions.

As shown in FIG. 4, the quantization bit expansion unit 16 expands the number of quantization bits of the audio signal of each of the four channels. In this example, the PC 1 adds 8 least significant bits to the number of quantization bits (16 bits) of the audio signal of each of the four channels for an expansion to 24 bits.

With the expansion region added to each sample of the audio signal, the reference bit position of each sample of the audio signal of each of the four channels is the least significant bit (bit8) of the upper 16 bits (bit8-bit23).

Figure 5:
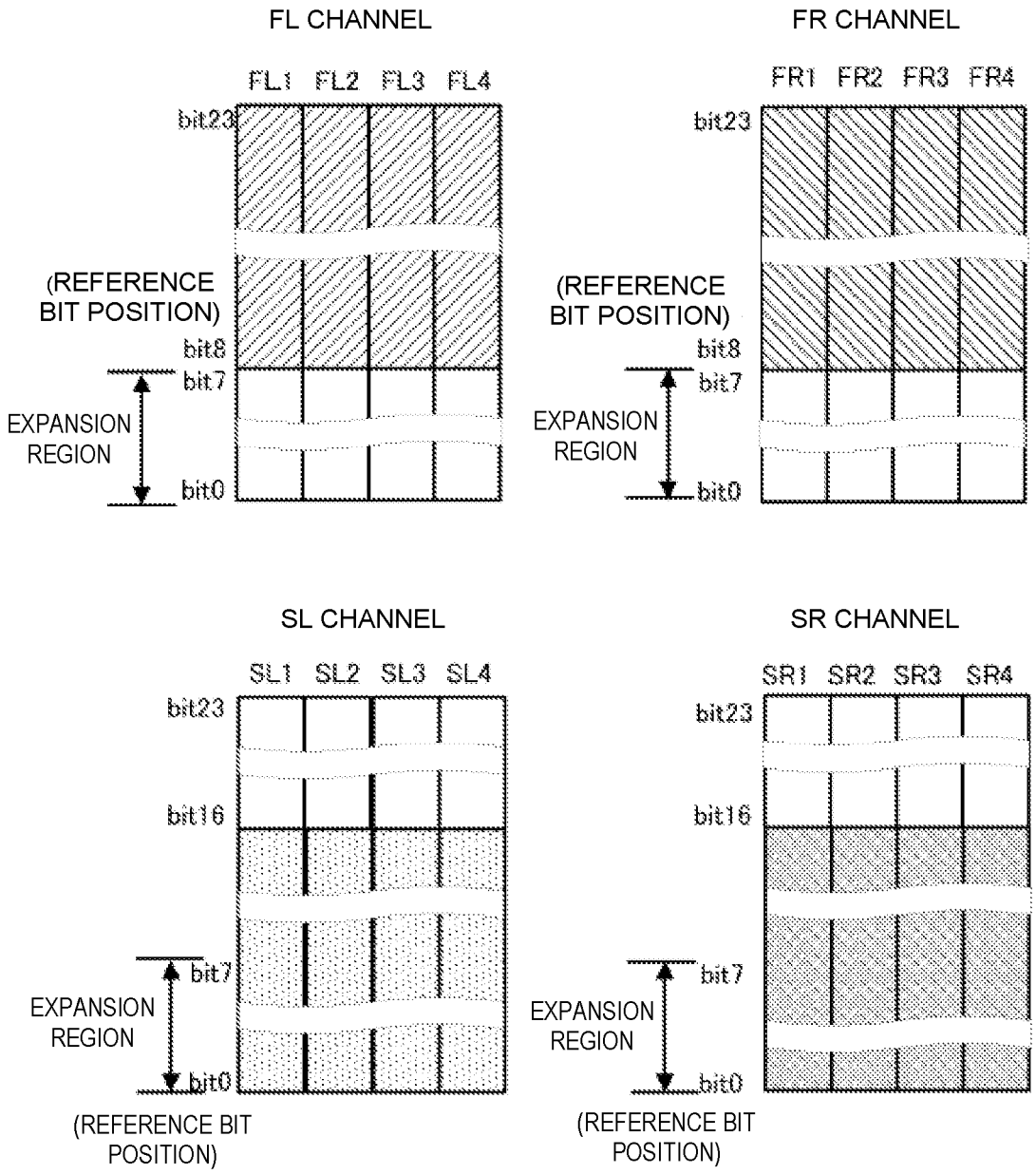
FIG. 5 is an explanatory diagram illustrating the audio signal of each channel when the audio signals of the SL channel and the SR channel are shifted.

FIG. 5 is an explanatory diagram illustrating the audio signal in each channel when the audio signals of the SL channel and the SR channel are shifted. In FIG. 5, the horizontal axis of each channel represents samples (time) and the vertical axis represents bits (volume).

The audio signal processing unit 17 generates an output signal in which the plurality of channels are downmixed such that an audio signal of at least one channel from among the plurality of channels is arranged at a reference bit position different from a reference bit position for an audio signal of a different channel of the plurality of channels, by using the expansion region. For example, as shown in FIG. 5, the audio signal processing unit 17 stores the audio signal of the FL channel in the region of the upper 16 bits. That is, the reference bit position of the FL channel is bit8. Here, the audio signal processing unit 17 stores a "0" in the lower 8 bits (expansion region) of the audio signal of the FL channel. The audio signal processing unit 17 shifts the audio signal of the SL channel down 8 bits such that the reference bit position of the audio signal of the SL channel becomes bit0. The audio signal processing unit 17 stores a "0" in each bit of bit16-bit23 of the audio signal of the SL channel, which has been shifted down 8 bits. That is, the audio signal processing unit 17 arranges the audio signal of the SL channel so as to have a reference bit position that differs from that of the audio signal of the FL channel.

Further, the audio signal processing unit 17 stores the audio signal of the FR channel in the region of the upper 16 bits. That is, the reference bit position of the FR channel is bit8. In this case, the audio signal processing unit 17 stores a "0" in the lower 8 bits (expansion region) of the audio signal of the FR channel. Further, the audio signal processing unit 17 shifts the audio signal of the SR channel down 8 bits such that the reference bit position of the audio signal of the SR channel is bit0. The audio signal processing unit 17 stores a "0" in each bit of bit16-bit23 of the audio signal of the SR channel, which has been shifted down 8 bits. That is, the audio signal processing unit 17 arranges the audio signal of the SR channel so as to have a reference bit position that differs from that of the audio signal of the FR channel.

The audio signal processing unit 17 downmixes the 4-channel audio signal into a 2-channel (Lo channel and Ro channel) audio signal (output signal).

Figure 6:
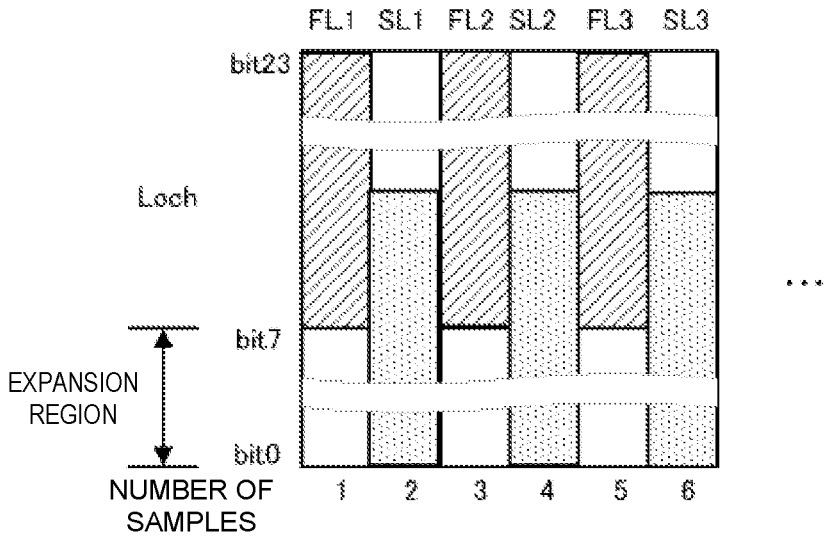
FIG. 6 is an explanatory diagram illustrating a signal obtained by downmixing the FL channel and the SL channel, and a signal obtained by downmixing the FR channel and the SR channel.
Figure 6:
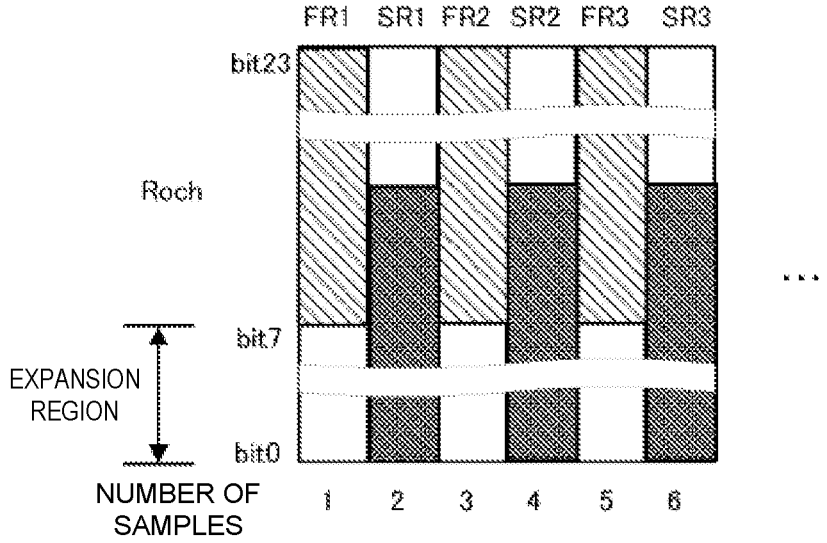

FIG. 6 is an explanatory diagram illustrating a signal obtained by downmixing the FL channel and the SL channel, and a signal obtained by downmixing the FR channel and the SR channel. In FIG. 6, the horizontal axis of the Lo channel and the Ro channel represents samples (time) and the vertical axis represents bits (volume).

The audio signal processing unit 17 arranges the audio signals of the plurality of channels in order. As shown in FIG. 6, the audio signal processing unit 17 stores an SL1 sample between an FL1 sample and an FL2 sample. Further, the audio signal processing unit 17 stores an SL2 sample between the FL2 sample and an FL3 sample. Further, the audio signal processing unit 17 stores an SL3 sample between the FL3 sample and an FL4 sample (not shown). Each of the samples of the FL channel and the SL channel are arranged in alternating fashion in this manner, so that the FL channel and the SL channel are downmixed into one channel (Lo channel).

Further, the audio signal processing unit 17 stores an SR1 sample between an FR1 sample and an FR2 sample. Further, the audio signal processing unit 17 stores an SR2 sample between the FR2 sample and an FR3 sample. Further, the audio signal processing unit 17 stores an SR3 sample between the FR3 sample and an FR4 sample (not shown). Each samples of the FR channel and the SR channel are arranged in alternating fashion in this manner, so that the FR channel and the SR channel are downmixed into one channel (Ro channel).

In this way, the signal generated as a result of the alternating arrangement of the samples of the audio signals of two channels by the audio signal processing unit 17 becomes an upsampled signal. That is, each channel sampled at a sampling frequency of 48 kHz is upsampled, so that the sampling frequency of the Lo channel and the Ro channel becomes 96 kHz, which is twice the 48 kHz sampling frequency.

The audio signal processing unit 17 can upsample and then downmix a plurality of channels.

Thus, the PC 1 makes it possible to distinguish the two channels that constitute the Lo channel by making the reference bit position of the audio signal of the FL channel and the reference bit position of the audio signal of the SL channel in the Lo channel different. In addition, the PC 1 makes it possible to distinguish the two channels that constitute the Ro channel by making the reference bit position of the audio signal of the FR channel and the reference bit position of the audio signal of the SR channel in the Ro channel different.

The I/F 18 outputs the output signals of the two channels (Lo channel, Ro channel) to the AV receiver 2. In this example, the I/F 18 corresponds to an output interface (output unit) of this disclosure.

The PC 1 is connected to the AV receiver 2 wirelessly or by wire via the I/F 18.

The I/F 18 can also output the audio signal as audio data in a lossless uncompressed format or a lossless compressed format. Examples of a lossless uncompressed format include WAV (Waveform Audio Format) and LPCM (Linear Pulse Code Modulation). Examples of a lossless compressed format include FLAC (Free Lossless Audio Codec) and ALAC (Apple Lossless Audio Codec). In addition, the I/F 18 can output LPCM audio data in a standard conforming to S/PDIF or HDMI (High-Definition Multimedia Interface) (registered trademark).

In the present embodiment, a 2-channel output signal is described, but the number of channels of the output signal can be one channel, or three or more channels.

Figure 7:
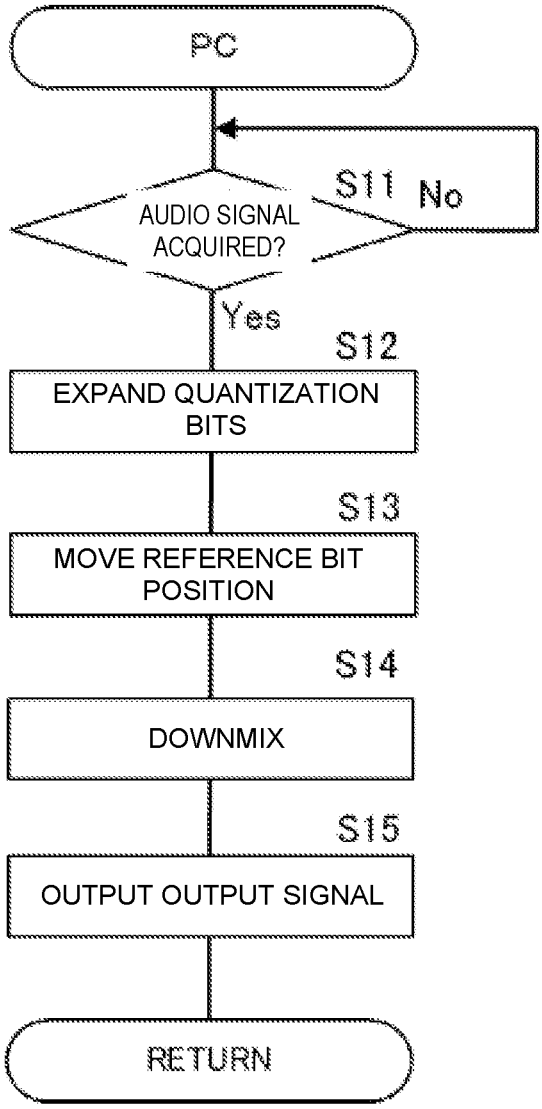
FIG. 7 is a flowchart illustrating one example of the operation of the PC.

The operation of the audio signal output method of the PC 1 will be described with reference to FIG. 7. FIG. 7 is a flowchart illustrating one example of an operation of the PC 1. This disclosure is not limited to the operation of the PC 1 shown in FIG. 7.

When the audio signal of each of the four channels is received (S11: Yes), the PC 1 expands the number of quantization bits of each sample of the audio signal of each channel (S12). The PC 1 shifts each sample of the audio signals of the SL channel and the SR channel such that the reference bit positions of the SL channel and the SR channel differ from those of the FL channel and the FR channel (S13). At this time, the PC 1 stores a "0" in each of bit16-bit23 of each sample of the audio signals of the SL channel and the SR channel. Of the four channels, the PC 1 alternately arranges and downmixes (upsamples) each sample of the audio signal of the FL channel and each sample of the audio signal of the SL channel (S14). In addition, each sample of the audio signal of the FR channel and each sample of the audio signal of the SR channel are alternately arranged and downmixed (upsampled) (S14). The PC 1 outputs the output signals of the Lo channel, which is composed of the FL channel and the SL channel, and the Ro channel, which is composed of the FR channel and the SR channel (S15).

In this manner, the PC 1 outputs an output signal with distinguishable channels by making the reference bit positions of the audio signal of the FL channel and of the audio signal of the SL channel in the Lo channel differ. In addition, the PC 1 outputs an output signal with distinguishable channels by making the reference bit positions by making the reference bit positions of the audio signal of the FR channel and of the audio signal of the SR channel in the Ro channel differ. That is, the PC 1 outputs a signal with which a receiving-side device (such as the AV receiver 2) could identify the channels solely by means of the output signal, without outputting a separate signal for identifying the channels. Therefore, the PC 1 is able to output a signal with which the channels can be reliably identified.

An example was described in the foregoing in which four channels are downmixed into two channels and output, but the PC 1 can downmix four channels into one channel and output an output signal with one channel. In addition, the PC 1 can acquire the audio signals of four or more channels. Moreover, the PC 1 can acquire audio signals of four or more channels, and output audio signals of three or more channels.

Further, an example was described in which both the SL channel and the SR channel are shifted down 8 bits, but no limitation is imposed thereby. The audio signal processing unit 17 can also shift the SL channel and the SR channel down by a different number of bits. For example, the audio signal processing unit 17 can shift the audio signal of the SL channel down 8 bits and shift the audio signal of the SR channel down 7 bits.

Further, the audio signal acquisition unit 11 can acquire audio signals from a USB memory or a streaming service, for example. In the case that the audio signal is a digital signal, the acquired audio signal from the audio signal acquisition unit 11 bypasses the A/D converter 15 and is input to the quantization bit expansion unit 16.

Further, the audio signal processing unit 17 can shift the audio signals of the SL channel and the SR channel down so that the reference bit positions of the audio signal of each channel differ after downmixing four channels into two channels.

Figure 8:
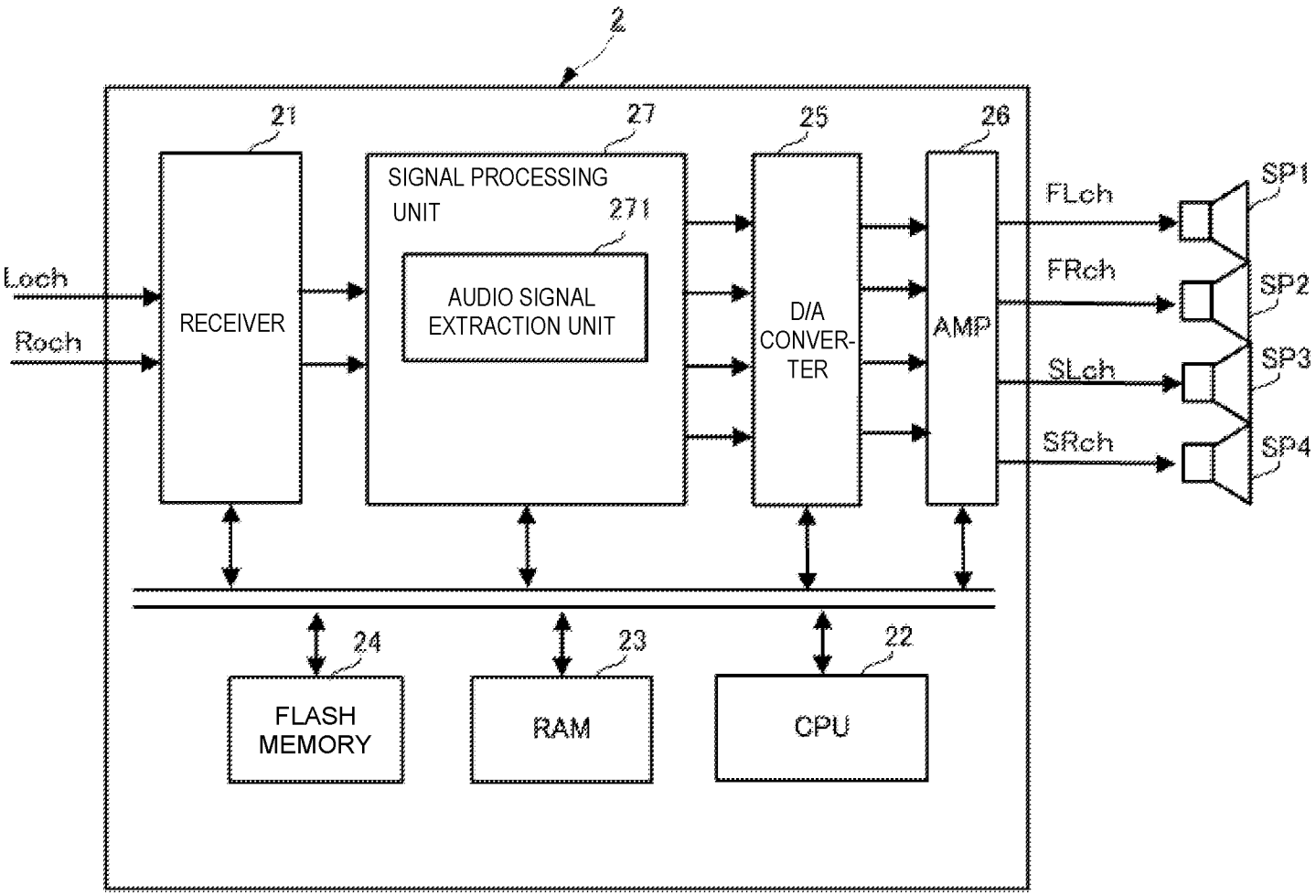
FIG. 8 is a block diagram illustrating the main configuration of an AV receiver.

The AV receiver 2 will be described with reference to FIG. 8. FIG. 8 is a block diagram illustrating the main configuration of the AV receiver 2.

In this example, the AV receiver 2 is a device that extracts 4-channel audio signals from the received Lo channel and Ro channel and outputs the signals to four speakers (SP1, SP2, SP3, SP4). The AV receiver 2 extracts the audio signal of each of the original two channels (FL channel and SL channel) in accordance with the volume difference (difference in the reference bit positions) for each sample of the Lo channel. In the same manner as for the Lo channel, the AV receiver 2 extracts the audio signal of each of the original two channels (FR channel and SR channel) for the Ro channel.

As shown in FIG. 8, the AV receiver 2 includes a receiver 21, at least one processor such as a CPU (Central Processing Unit) 22, a RAM (Random Access Memory) 23, a flash memory 24, a D/A (Digital to Analog) converter 25, an AMP (Amplifier) 26, and a signal processing unit 27.

The receiver 21 receives the Lo channel and Ro channel output signals that are output from the PC 1.

The CPU 22 reads an operating program (firmware) stored in the flash memory 24 into the RAM 23 and integrally controls the AV receiver 2.

The signal processing unit 27 corresponds to a second electronic controller such as a DSP (Digital Signal Processor) and includes an audio signal extraction unit 271. The audio signal extraction unit 271 extracts each of the audio signals of the plurality of channels in accordance with the number of the plurality of channels.

The audio signal extraction unit 271 extracts the audio signal of each channel in accordance with the volume difference of the audio signal for each sample.

From the received output signals, the audio signal extraction unit 271 identifies the first channel whose reference bit position is bit8 as the first channel. More specifically, the audio signal extraction unit 271 identifies the channel of the audio signal whose reference bit position is bit8 as the FL channel from the audio signals of the Lo channel. In addition, the audio signal extraction unit 271 identifies the channel of the audio signal whose reference bit position is bit0 as the SL channel from the audio signals of the Lo channel.

Further, the audio signal extraction unit 271 identifies the channel of the audio signal whose reference bit position is bit8 as the FR channel from the audio signals of the Ro channel. Moreover, the audio signal extraction unit 271 identifies the channel of the audio signal whose reference bit position is bit0 as the SR channel from the audio signals of the Ro channel.

The audio signal extraction unit 271 extracts the audio signals of the identified channels.

The audio signal extraction unit 271 shifts the audio signal up 8 bits such that the reference bit positions of the audio signals of the SL channel in the Lo channel and the SR channel in the Ro channel become bit8. The AV receiver 2 is thereby capable of reproducing the SL channel and SR channel audio signals at the same volume as the audio signals acquired by the PC 1.

The audio signal extraction unit 271 determines whether the received audio signal has been upsampled. When it is determined that the received audio signal has been upsampled, the audio signal extraction unit 271 carries out downsampling. The audio signal extraction unit 271 calculates the frequency to which downsampling is to be carried out based on the number of identified channels.

For example, if the received output signals have two channels, the Lo channel and the Ro channel, and the Lo channel and the Ro channel each include audio signals having a total of four channels, the FL, SL channels, and the FR, SR channels, respectively, the audio signal extraction unit 271 determines that the Lo channel and the Ro channel have each been upsampled twice.

The audio signal extraction unit 271 extracts the audio signal of each channel (FL channel, FR channel, SL channel, and SR channel). At this time, the audio signal extraction unit 271 stores the same sample data in the even-numbered samples of each channel as the odd-numbered samples, for example.

More specifically, the audio signal extraction unit 271 uses an SRC (Sample Rate Conversion) function and downsamples the 96 kHz sampling frequency by half to 48 kHz.

Typically, the SRC function carries out downsampling by averaging a plurality of samples. Therefore, if different bits are stored in the even-numbered samples and the odd-numbered samples, the bits will become different when downsampled.

However, the SRC function used in this example is not typical, but is an SRC function in which the averaging process described above is not carried out. By storing the same sample data in the even-numbered samples as in the odd-numbered samples of each channel, the audio signal extraction unit 271 is able to completely restore the original bits even if downsampling is carried out by means of the SRC function.

Further, the audio signal extraction unit 271 can extract an audio signal ever other sample by means of the same process as the SRC function to restore the original bits of the audio signal.

The D/A converter 25 coverts each of the 4-channel audio signals extracted by the audio signal extraction unit 271 into an analog signal.

The AMP 26 amplifies each of the analog audio signals converted by the D/A converter 25 and outputs the amplified signals to the corresponding speakers SP1, SP2, SP3, and SP4.

Figure 9:
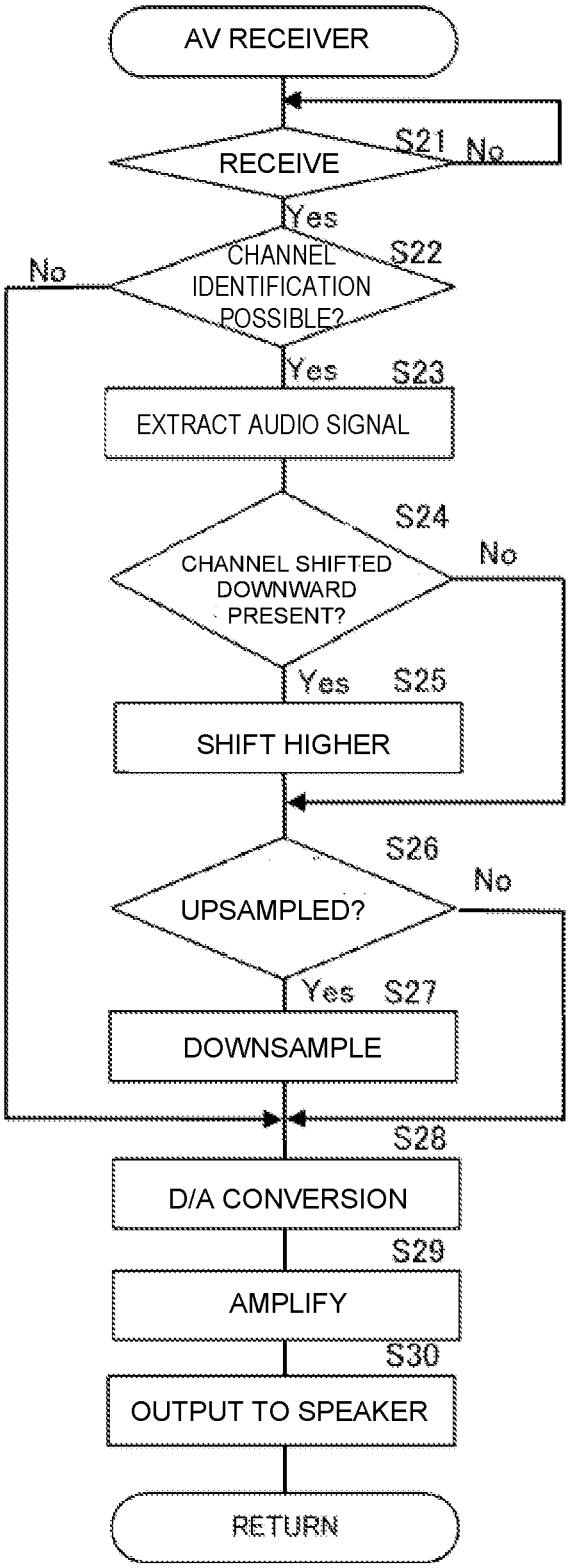
FIG. 9 is a flowchart illustrating one example of the operation of the AV receiver.

The operation of the AV receiver 2 will be described with reference to FIG. 9. FIG. 9 is a flowchart illustrating one example of the operation of the AV receiver 2. This disclosure is not limited to the operation of the AV receiver 2 shown in FIG. 9.

If the AV receiver 2 receives the output signal output by the PC 1 (S21: Yes), and it is possible to identify the channel based on the reference bit position (S22: Yes), the AV receiver 2 extracts the audio signal of the identifiable channel (S23).

If the reference bit position of the extracted audio signal is in the expansion region (S24: Yes), the AV receiver 2 shifts said audio signal up (S25). In this case, the AV receiver 2 shifts the audio signals up by a predefined number of bits for each channel (for example, by the number of shifted bits predetermined for each channel between the PC 1 and the AV receiver 2) (for example, shifting up 8 bits for the SL channel in this case). In addition, in regard to the channels that have been shifted down (in this case, the SL channel and the SR channel), the AV receiver 2 shifts these channels up by the number of detected bits based on the number of bits in the expansion region, and the like. If the audio signal has been upsampled (S26: Yes), the AV receiver 2 downsamples the audio signal (S27).

If the reference bit position of the extracted audio signal has not been shifted down (S24: No), the AV receiver 2 causes the process to proceed to S26. If the audio signal has not been upsampled (S26: No), the AV receiver 2 causes the process to proceed to S28. In addition, if the AV receiver 2 cannot identify the channel based on the reference bit position of the received output signal (S22: No), the AV receiver 2 causes the process to proceed to S28.

A case in which it is not necessary to identify the channel means a case in which the order of channels constituting the output signal is predetermined between the PC 1 and the AV receiver 2, as in Modified Example 4 described further below.

The AV receiver 2 converts each of the 4-channel digital audio signals into an analog audio signal (S28). The AV receiver 2 amplifies each of the 4-channel analog audio signals (S29). The AV receiver 2 outputs each of the amplified analog audio signals of the four channels to the corresponding speakers (SP1, SP2, SP3, SP4), (S30).

In this manner, the AV receiver 2 is able to extract audio signals of each of the four channels from the Lo channel and the Ro channel and to reproduce the signals by means of the corresponding speakers (SP1, SP2, SP3, SP4).

Further, the AV receiver 2 can store each of the 4-channel audio signals extracted from the output signals of the received Lo channel and Ro channel in a memory (for example, RAM 23 or flash memory 24) provided in the device itself.

If the sample of the channel represents silence, the sample data for this channel will be "0." In this case, the AV receiver 2 cannot identify the channels from the Lo channel and the Ro channel, and the first channels of the Lo channel and the Ro channel (in this case, the FL channel and the FR channel) cannot be detected. Therefore, because the audio signal processing unit 17 always stores a "1" at the reference bit positions of the FL channel and the FR channel, which are the first channels, the audio signal extraction unit 271 can reliably detect the FL channel and the FR channel.

Further, if the sample represents silence in each of the channels (FL channel, FR channel, SL channel, and SR channel), the audio signal processing unit 17 generates an output signal in which a "1" is always stored in the reference bit position of the sample of each channel (bit4 of the FL channel and the FR channel, and bit0 of the SL channel and the SR channel). As a result, the AV receiver 2 can reliably identify each channel even if a silent sample is included in the audio signal.

Further, when a sample of a channel represents silence, the audio signal processing unit 17 can always store a "1" in a bit that is one bit lower than the reference bit position of the FL channel (bit3 in the case of the FL channel and the FR channel). In this case, the bit data before the expansion of the number of quantization bits is not changed to other bit data. As a result, the AV receiver 2 can reliably detect the FL channel and the FR channel, which are the first channels, and to completely restore the bit data of the FL channel and the FR channel.

Modified Example 1

Figure 10:
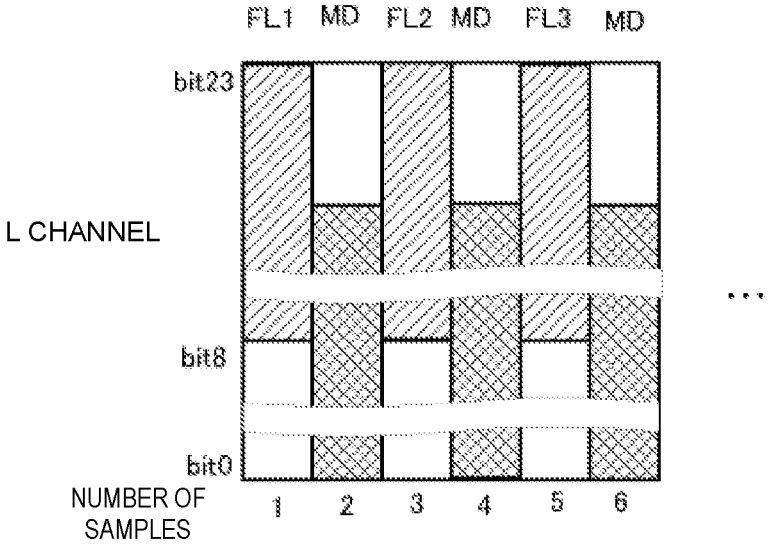
FIG. 10 is an explanatory diagram illustrating one example of an output signal according to Modified Example 1.
Figure 11:
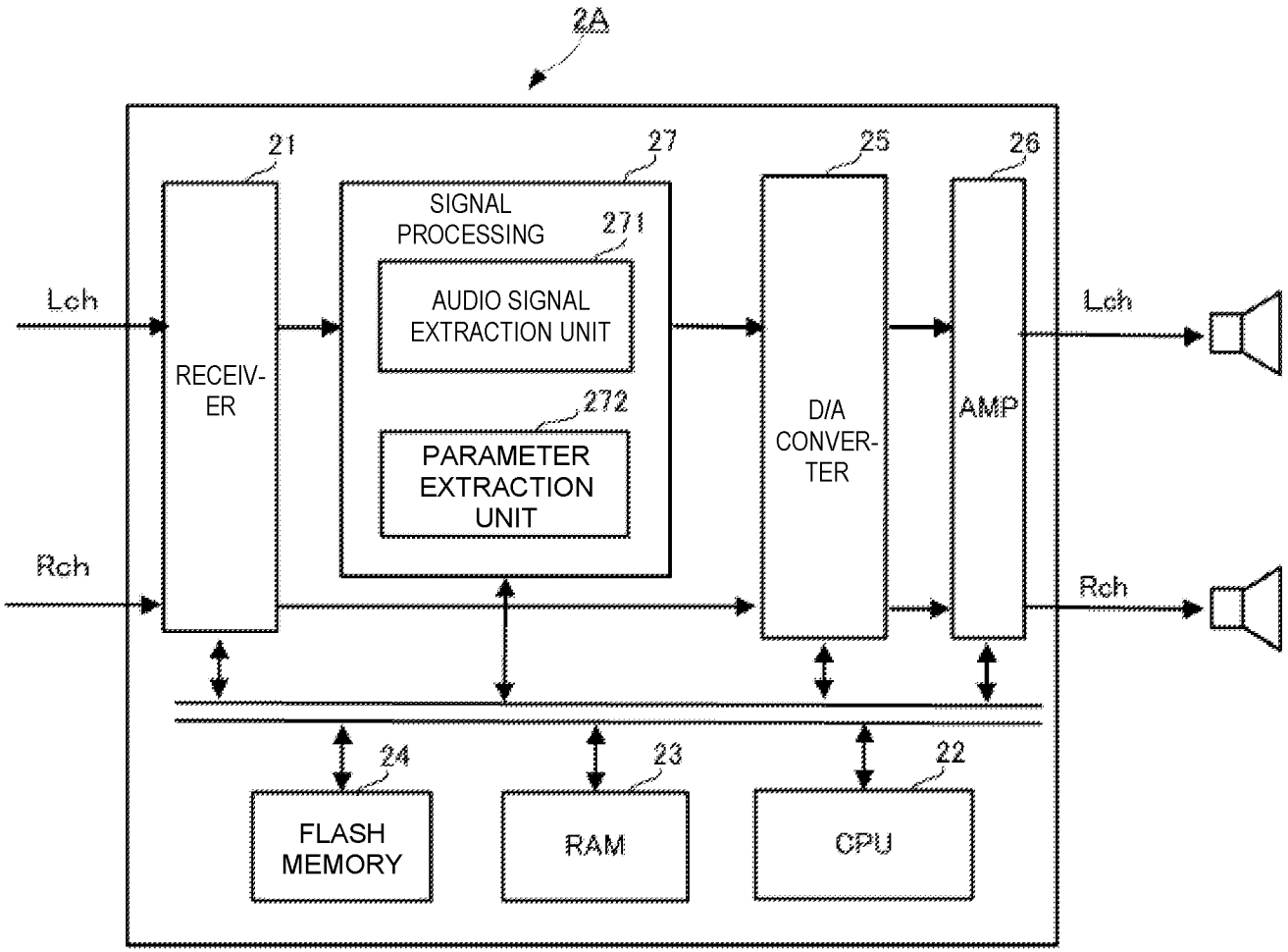
FIG. 11 is a block diagram illustrating the main configuration of an AV receiver according to Modified Example 1.

An output signal output from the PC 1 and an AV receiver 2A of Modified Example 1 will be described with reference to FIGS. 10 and 11. FIG. 10 is an explanatory diagram illustrating one example of the output signal. In FIG. 10, the horizontal axis of the channel represents samples (time) and the vertical axis represents bits (volume). FIG. 11 is a block diagram illustrating the main configuration of AV receiver 2A. Components that are the same as those of the AV receiver 2 described above have been assigned the same reference symbols, and their descriptions have been omitted.

For example, the PC 1 acquires audio signals of two channels (L channel and R channel) and outputs the audio signal of one (for example, the L channel) and a signal processing parameter MD of said audio signal in one channel. The signal processing parameters MD in this example is, for example, information specifying the type of effector to be applied to the audio signal, and a parameter for the effector (gain, delay, sound image position, and the like).

In this example, the quantization bit expansion unit 16 adds an 8-bit expansion region to the audio signal of the L channel.

The audio signal processing unit 17 upsamples the audio signal of the L channel. That is, the audio signal processing unit 17 doubles the sampling frequency of the audio signal of the L channel to carry out sampling.

As shown in FIG. 10, the audio signal processing unit 17 stores the signal processing parameter MD in the even-numbered samples of the L-channel signals that have been expanded to 24 bits and upsampled. That is, the audio signal processing unit 17 arranges the signal processing parameter MD and the audio signal of the FL channel in alternating fashion. In addition, the audio signal processing unit 17 stores the signal processing parameter MD in the expanded lower bit side.

As shown in FIG. 11, the signal processing unit 27 of the AV receiver 2A further comprises a parameter extraction unit 272.

The audio signal extraction unit 271 identifies the channel of the audio signal (L channel) based on the reference bit position. In this example, if the reference bit position is bit8, it is determined that the channel of the sample is the L channel. The audio signal extraction unit 271 carries out downsampling and restores the audio signal of the L channel.

The parameter extraction unit 272 extracts the signal processing parameter MD based on the reference bit position. In this example, if the reference bit position is bit0, the parameter extraction unit 272 determines it to be the signal processing parameter MD.

In this manner, the PC 1 of Modified Example 1 can simultaneously output an audio signal and a signal processing parameter MD relating to the audio signal based on the reference bit position in the L channel.

Further, since the signal processing parameter MD relating to the audio signal is received at the same time as the audio signal, the AV receiver 2A can use the signal processing parameter MD at the same timing as the audio signal.

The CPU 22 can store the signal processing parameter MD extracted by the parameter extraction unit 272 in memory (for example, RAM 23 or flash memory 24).

Further, the signal processing parameter MD can include metadata, such as a song title. Further, the signal processing parameter MD can also include a lighting control signal, etc., which is used at the same time that the audio signal is reproduced. The signal processing parameter MD can include other control signals. In this case, the AV receiver 2A can be controlled by the CPU 22, or the like, and output from the signal processing unit 27 to the outside.

Further, the signal processing parameter MD can include position information for localization of a sound image. In this case, for example, the PC 1 downmixes and outputs the audio signal and the position information. The AV receiver 2A carries out a process for localizing the sound image for the audio signal based on the position information of the received output signal.

The PC 1 can also be configured to mix and output the R channel and the signal processing parameter MD in one channel.

Modified Example 2

Figure 12:
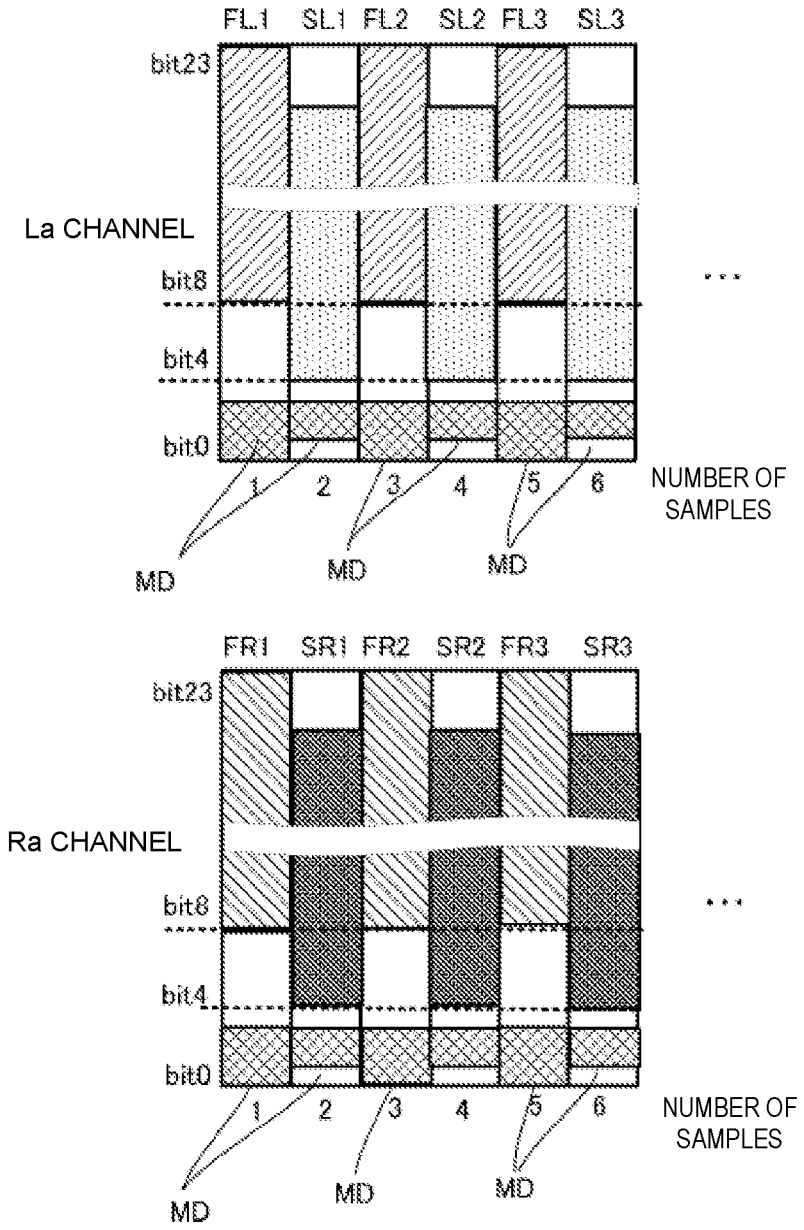
FIG. 12 is an explanatory diagram illustrating an output signal of an La channel and an output signal of an Ra channel according to Modified Example 2.
Figure 13:
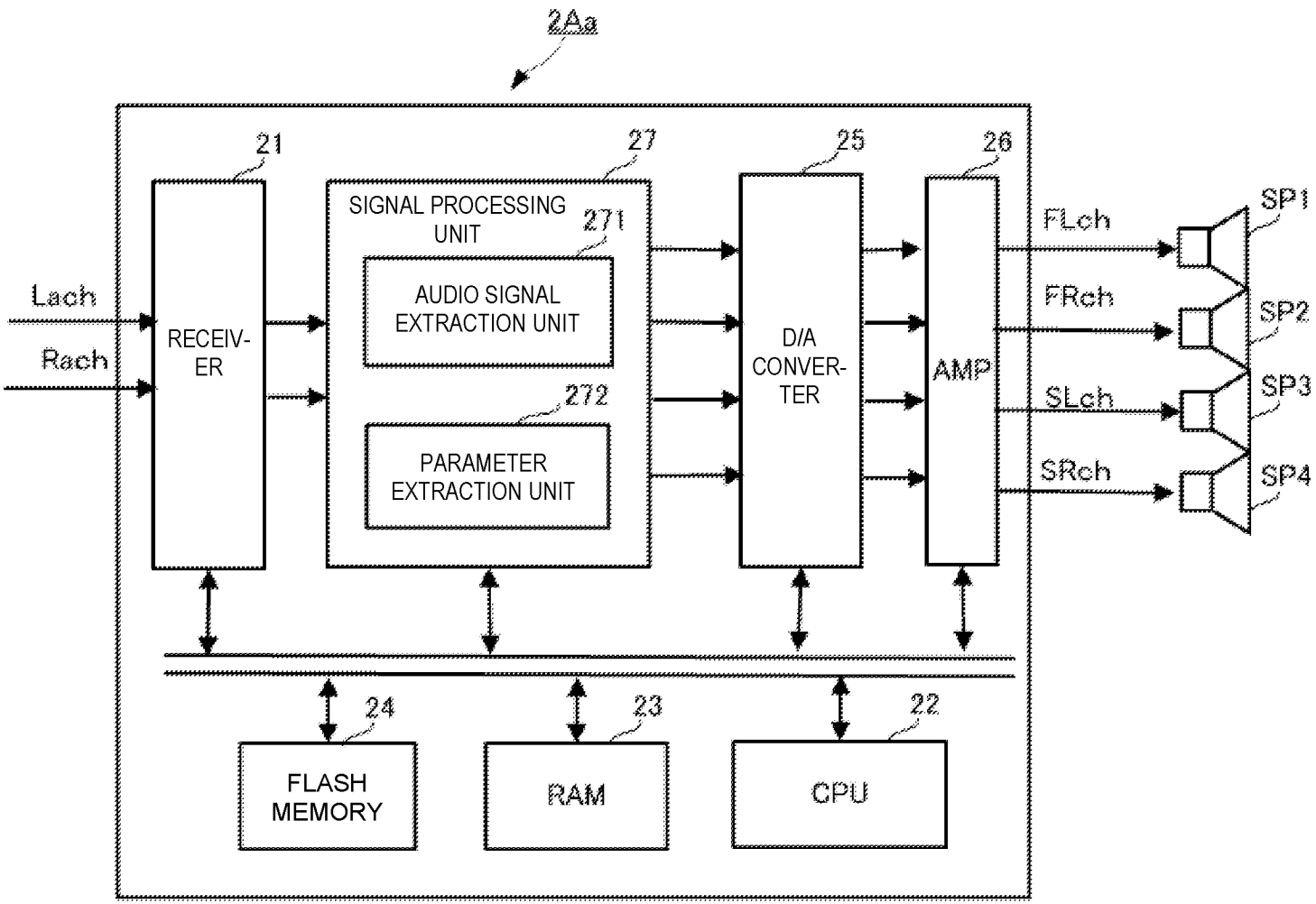
FIG. 13 is a block diagram illustrating the main configuration of an AV receiver according to Modified Example 2.
Figure 14:
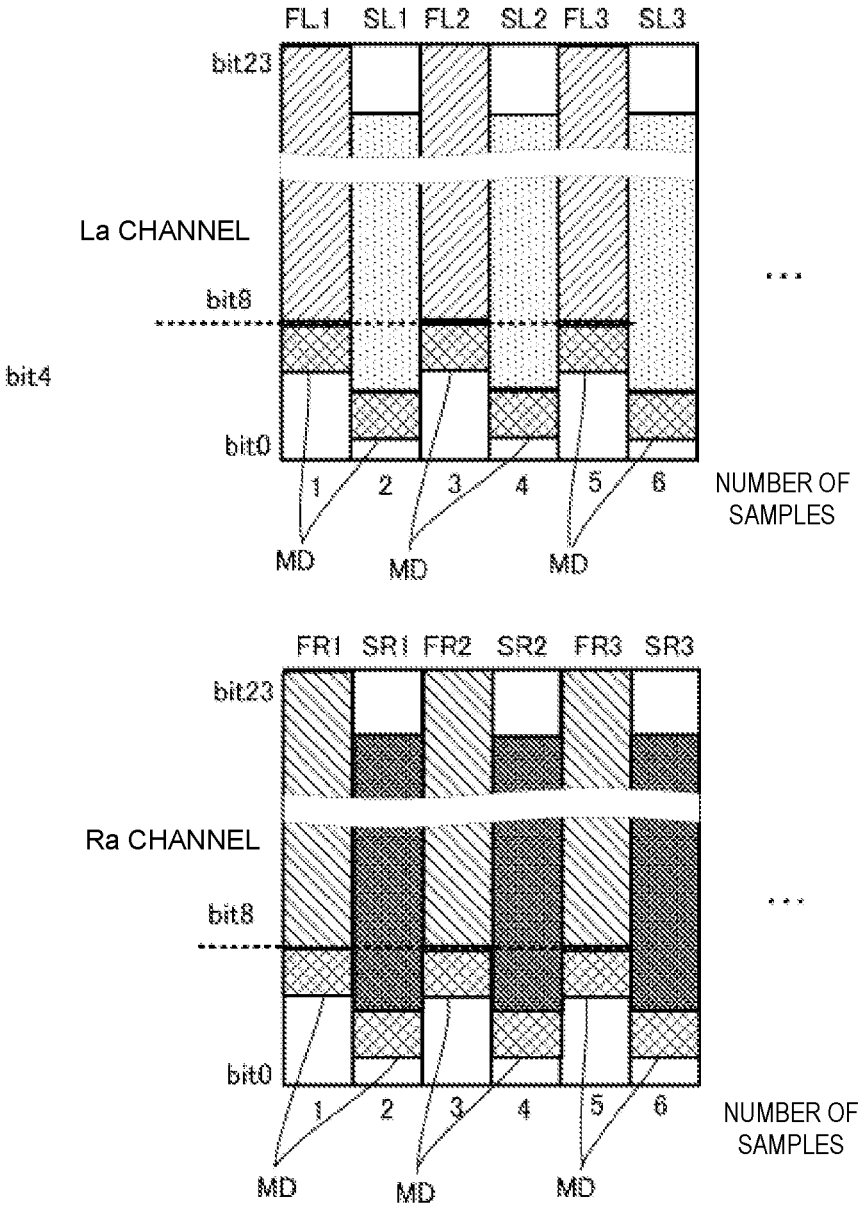
FIG. 14 is an explanatory diagram illustrating another example of an output signal of the La channel and an output signal of the Ra channel according to Modified Example 2.

An output signal output from the PC 1 and AV receiver 2Aa of Modified Example 2 will be described with reference to FIGS. 12, 13, and 14. FIG. 12 is an explanatory diagram illustrating the output signal of an La channel and the output signal of an Ra channel. FIG. 13 is a block diagram illustrating the main configuration of AV receiver 2Aa. FIG. 14 is an explanatory diagram illustrating another example of an output signal of the La channel according to Modified Example 2 and an output signal of the Ra channel according to Modified Example 2. In FIGS. 12 and 14, the horizontal axis of each channel represents samples (time) and the vertical axis represents bits (volume). The PC 1 predefines the reference bit position for each audio signal of the four channels.

The audio signal processing unit 17 adds a signal processing parameter of each of the audio signals in a different position than a reference bit position of each of the audio signals. For example, before downmixing the audio signals of four channels into two channels, as shown in FIG. 12, the audio signal processing unit 17 shifts the audio signal of the SL channel down a prescribed number of bits (4 bits) such that the reference bit position of the audio signal of the SL channel is bit4. In this case, the audio signal processing unit 17 stores the signal processing parameter MD of each audio signal in the lowest four bits of the audio signal of the FL channel and of the audio signal of the SL channel.

The audio signal processing unit 17 shifts the audio signal of the SR channel down a prescribed number of bits (4 bits) such that the reference bit position of the audio signal of the SR channel is bit4. In this case, the audio signal processing unit 17 stores the signal processing parameter MD of each audio signal in the lowest four bits of the audio signal of the FR channel and of the audio signal of the SR channel.

The PC 1 can output an output signal whose channels can be identified by making the reference bit positions of the two channels different, and also output the signal processing parameter MD simultaneously with the corresponding audio signal.

The AV receiver 2Aa identifies the channel based on the reference bit position and extracts the audio signal for each channel and the signal processing parameter MD of the audio signal.

The parameter extraction unit 272 extracts the signal processing parameter MD of the audio signal based on the reference bit positions of the audio signals of the FL channel and the SL channel in the La channel. That is, the parameter extraction unit 272 extracts the signal processing parameter MD stored in the lowest four bits of the FL channel and the SL channel of the La channel received by the receiver 21.

Similarly, the parameter extraction unit 272 extracts the signal processing parameter MD stored in the lowest four bits of the FR channel and the SR channel.

In this manner, the PC 1 of Modified Example 2 can simultaneously output a 4-channel audio signal and a signal processing parameter MD relating to the 4-channel audio signal in the La channel and in the Ra channel.

Further, since the signal processing parameter MD relating to the audio signal is received at the same time as the audio signal, the AV receiver 2Aa can use the signal processing parameter MD at the same timing as the audio signal.

If the sample represents silence in each channel, zeroes should be stored in the sampling data. In this case, the audio signal extraction unit 271 would not be able to identify which channel is being indicated by the sample representing the silence. Therefore, the audio signal processing unit 17 of the PC 1 outputs an output signal in which a "1" is always stored in the reference bit position of the sample of each channel (bit8 of the FL channel and the FR channel, and bit4 of the SL channel and the SR channel). As a result, the AV receiver 2Aa can reliably identify each channel even if a silent sample is included in the audio signal, and use the signal processing parameter MD corresponding to each channel.

Further, for example, when a sample represents silence in each channel, a "1" is always set as the bit that is one bit below the reference bit position of the FL channel, the FR channel, the SL channel, and the SR channel (for example, bit7 of the FL channel and the FR channel, and bit3 of the SL channel and the SR channel). As a result, the AV receiver 2Aa can also reliably identify each channel and restore the base data of the four channels.

Further, before or after downmixing, the audio signal processing unit 17 can appropriately shift the audio signal down such that, for example, the reference bit positions of the audio signals of the SL channel and the SR channel would become different from the reference bit positions of the audio signals of the FL channel and the FR channel.

Further, for example, as shown in FIG. 14, the audio signal processing unit 17 can store the signal processing parameter MD in the three bits immediately below the reference bit position of each channel. The audio signal processing unit 17 stores, for example, the signal processing parameters MD of the FL channel and the FR channel in bit5-bit7 of the samples of the FL channel and the FR channel. In addition, the audio signal processing unit 17 stores, for example, the signal processing parameters MD of the SL channel and the SR channel in bit3 to bit1 of the samples of the SL channel and the SR channel. In this case, the audio signal processing unit 17 always stores "1" in the lowest bit of the signal processing parameter MD of each channel. The AV receiver 2Aa can detect the shifted number of bits of each channel from the position of the lowest bit of the signal processing parameter MD of each channel in order to identify the channel.

Modified Example 3

Figure 15:
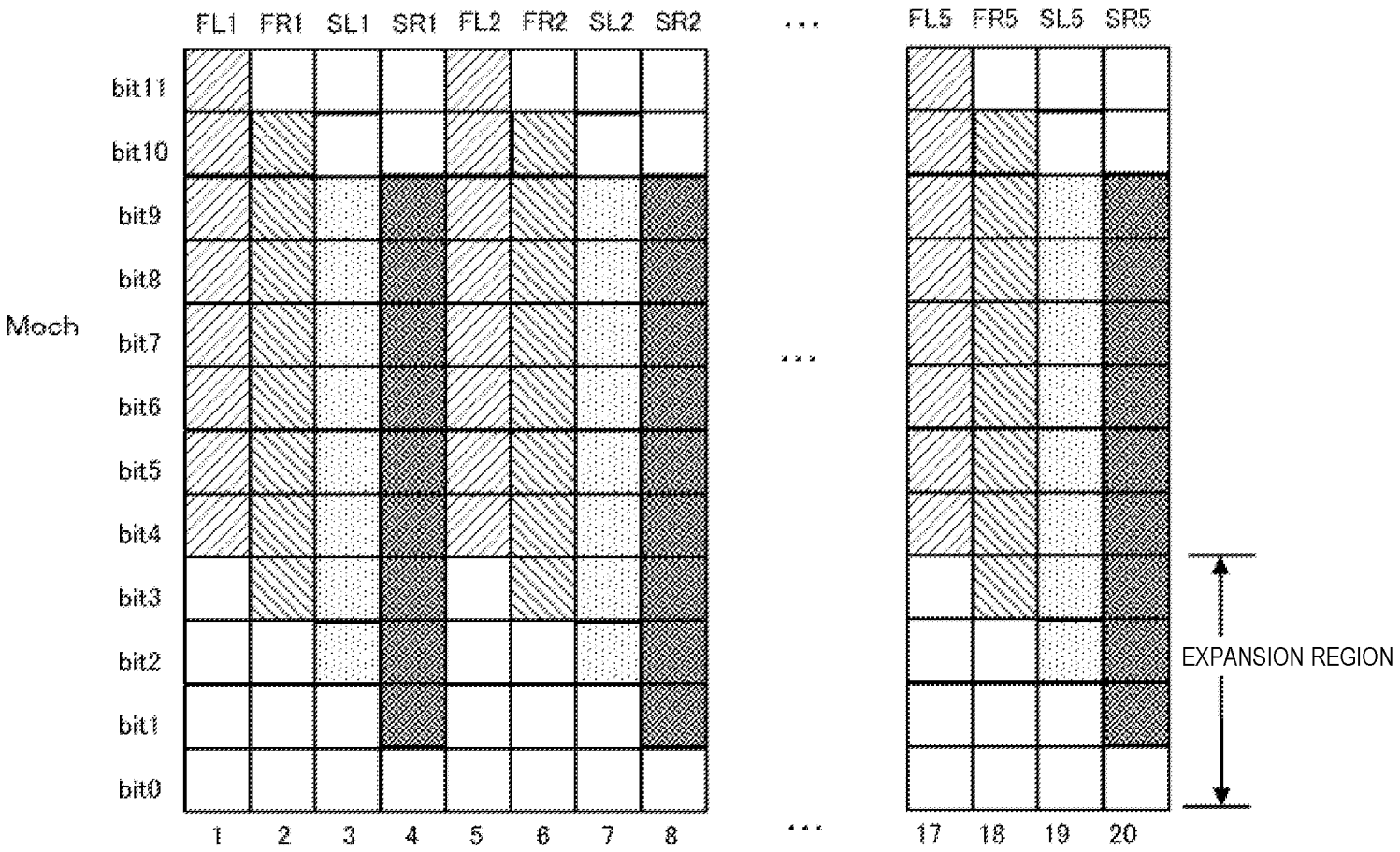
FIG. 15 is an explanatory diagram illustrating one example of an output signal according to Modified Example 3.
Figure 16:
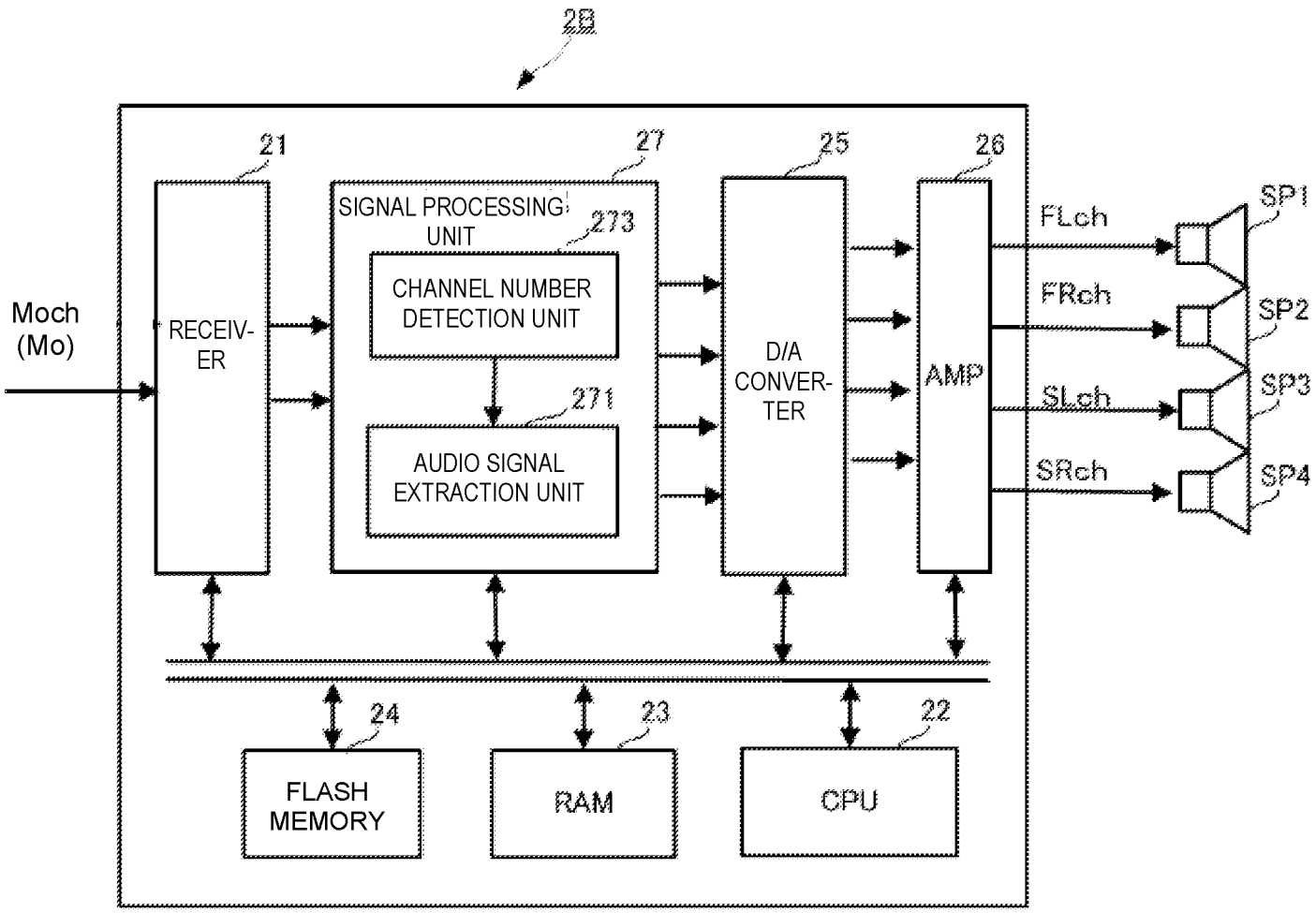
FIG. 16 is a block diagram illustrating the main configuration of an AV receiver according to Modified Example 3.

An output signal output by the PC 1 and an AV receiver 2B of Modified Example 3 will be described with reference to FIGS. 15 and 16. FIG. 15 is an explanatory diagram illustrating one example of the output signal. FIG. 16 is a block diagram illustrating the main configuration of the AV receiver 2B.

In FIG. 15, the horizontal axis represents samples (time) and the vertical axis represents bits (volume). Components that are the same as those of the AV receiver 2 described above have been assigned the same reference symbols, and their descriptions have been omitted. In addition, for the sake of convenience, this example will be described based on the assumption that the number of quantization bits of the audio signal of each of the four channels is 8 bits and that the number of bits of the expansion region is 4 bits. Further, in this example, an example of downmixing from four channels into one channel will be described.

In this example, as shown in FIG. 15, the PC 1 outputs the output signal of one channel. The quantization bit expansion unit 16 adds 4 least significant bits to the number of quantization bits (for example, 8 bits) of the audio signal of each of the four channels for an expansion to 12 bits. Further, the audio signal processing unit 17 upsamples the 48 kHz sampling frequency by four times to 192 kHz, and downmixes the acquired audio signals of the FL channel, the FR channel, the SL channel, and the SR channel into one channel.

Before downmixing, the audio signal processing unit 17 shifts the audio signals down such that the reference bit positions of the audio signal of the FL channel, the audio signal of the FR channel, the audio signal of the SL, and the audio signal of the SR channel would be different from each other. For example, the audio signal processing unit 17 shifts the audio signal down 1 bit such that the reference bit position of the audio signal of the FR channel becomes bit3. Further, the audio signal processing unit 17 shifts the audio signal down 2 bits such that the reference bit position of the audio signal of the SL channel becomes bit2. The audio signal is shifted down 3 bits such that the reference bit position of the audio signal of the SR channel becomes bit1.

"0" is stored in the lower 4 bits of the FL channel, the lower 3 bits of the FR channel, the lower 2 bits of the SL channel, and the lower 1 bit of the SR channel.

The audio signal processing unit 17 outputs to the AV receiver 2B the output signal of one channel (hereinafter referred to as output signal Mo) in which the audio signal of the FL channel, the audio signal of the FR channel, the audio signal of the SL channel, and the audio signal of the SR channel are mixed, via the I/F 18.

As shown in FIG. 16, the signal processing unit 27 of the AV receiver 2B further comprises a channel number detection unit 273.

The channel number detection unit 273 detects the number of the plurality of channels based on a reference bit position for each of the audio signals (samples) of the plurality of channels in the received output signal. The channel number detection unit 273 detects the number of channels using the output signal Mo of a prescribed number of samples. The channel number detection unit 273 assumes a prescribed number of channels and sets a prescribed period (the number of samples) in accordance with the assumed prescribed number of channels. The channel number detection unit 273 then determines if there are the assumed prescribed number of channels in the prescribed period. If the result of the determination is not the prescribed number of channels in the prescribed period, the channel number detection unit 273 resets the period and repeats the detection of the number of channels.

In this example, first, the channel number detection unit 273 assumes that the number of channels is two, and uses 20 pieces of sample data (assumed number of channels (2)× prescribed period) as the prescribed period, and determines whether the number of channels is two. As shown in FIG. 15, the channel number detection unit 273 determines if the piece of data in bit3 of the output signal Mo, in which sample data of four channels are contained, is "0" or "1." The channel number detection unit 273 detects whether the piece of data in bit3 from the output signal Mo is "0" or "1" for each sample for a prescribed period of time, and if the bit3 data repeat "1," "0" or "0," "1" for a prescribed number of times, except when there is silence, determines that the number of channels is two. That is, of the 20 samples, if the bit3 data is a repetition of the same pieces of data, such as "1," "1" or "0," "0," the audio signal extraction unit 271 determines that the number of channels is not two. Here, when it is determined that the number of channels is not two and it is detected that "1," "1" follow "0," "1" in the bit3 data, the channel number detection unit 273 assumes that there are four channels and resets the number of channels to detect.

The channel number detection unit 273 resets the prescribed period to 40 samples and determines whether the number of channels is four. If "0," "1," "1," "1" is repeated for a prescribed number of times in bit3, the channel number detection unit 273 determines that the number of channels constituting the output signal Mo is four. The channel number detection unit 273 can determine that the number of channels constituting the output signal Mo is four when "0," "0," "0," "1" is repeated for a prescribed number of times in bit1.

The number of samples during a prescribed period of time is not limited to the examples described above. For example, the number of samples during a prescribed period of time can be set to 10 times or more, or 10 times or less than the number of channels assumed by the AV receiver 2B.

The audio signal extraction unit 271 extracts the audio signals of the four channels based on the detection result. For example, the audio signal extraction unit 271 determines a sample in which the bit4 value is "1" and the bit3 value is "0" to be the FL channel and extracts the FL channel. The audio signal extraction unit 271 extracts a sample in which the bit3 value is "1" and the bit2 value is "0" as the FR channel. The audio signal extraction unit 271 extracts a sample in which the bit2 value is "1" and the bit1 value is "0" as the SL channel. The audio signal extraction unit 271 extracts a sample in which the bit1 value is "1" and the bit0 value is "0" as the SR channel.

In each channel, when there is silence, the audio signal extraction unit 271 cannot identify which channel is being indicated by the silent sample. Therefore, the audio signal processing unit 17 outputs an output signal Mo in which "1" is always stored in the reference bit position of the sample of each channel (bit4 of the FL channel, bit3 of the FR channel, bit2 of the SL channel, and bit1 of the SR channel). As a result, the AV receiver 2B can reliably identify each channel even if a silent sample is included in the audio signal. In this case, in each channel, "0" is stored in the bits below the reference bit position.

As a result, the AV receiver 2B can detect the number of channels, and identify and extract the audio signal of each channel, even if identification information indicating the number of channels is not separately received.

Also, in this example, when it is determined that the output signal Mo received by the receiver 21 has been upsampled, the audio signal extraction unit 271 carries out downsampling. For example, if the sampling frequency is 192 kHz, the audio signal extraction unit 271 downsamples at 48 kHz, which is a value obtained by dividing 192 kHz by the number of channels (in this example, four channels).

Further, the audio signal processing unit 17 can shift the audio signal down such that the reference bit position of the audio signal of each channel would become different, before or after downmixing.

Further, when a sample represents silence in each channel, the audio signal processing unit 17 can always set "1" as the bit that is one bit lower than the reference bit position of the FL channel, the FR channel, the SL channel, and the SR channel, for example. In this case, the bit data before the expansion of the number of quantization bits is not changed to other bit data. As a result, the AV receiver 2B can also reliably identify each channel and completely restore the 4-channel bit data (audio signal). In this case, a "0" is set as the bit below the bit that is one bit below the reference bit position.

Further, in the case that the audio signal is low volume, fade-in, or fade-out, if "1" is always stored in the reference bit position or the bits lower than the reference bit position, as described above, the AV receiver 2B can reliably identify each channel.

Modified Example 4

Figure 17:
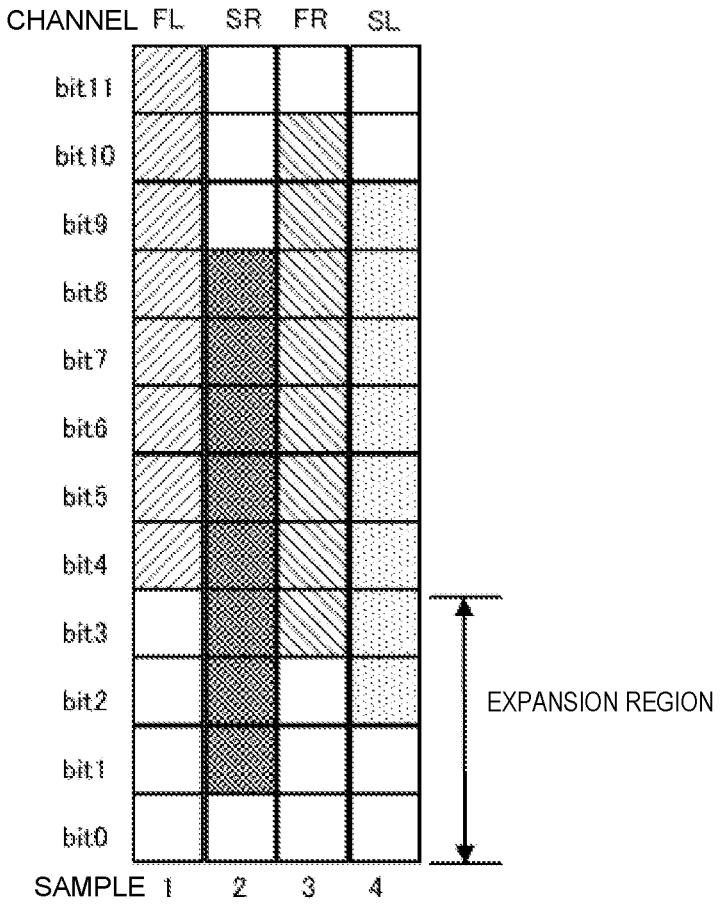
FIG. 17 is an explanatory diagram illustrating one example of an output signal according to Modified Example 4.

An output signal output by the PC 1 of Modified Example 4 will be described with reference to FIG. 17. FIG. 17 is an explanatory diagram illustrating one example of an output signal according to Modified Example 4. In FIG. 17, the horizontal axis represents samples (time) and the vertical axis represents bits (volume).

In this example, an example is described in which the audio signal itself stored in the expansion region is used as an effector parameter (for example, delay) for signal processing. In this example, the PC1 acquires four channels. However, the number of the channels is not limited to four, and can be two, three, or five or more.

As shown in FIG. 17, the audio signal processing unit 17 sets the reference bit position of the audio signal of the FL channel to bit4, for example. At this time, "0, 0, 0, 0" are stored in bit0-bit3, which is the expansion region of the FL channel. In addition, the audio signal processing unit 17 sets the reference bit position of the audio signal of the FR channel to bit3, for example. At this time, "0, 0, 0, 1" are stored in bit0-bit3, which is the expansion region of the FR channel. In addition, the audio signal processing unit 17 sets the reference bit position of the audio signal of the SL channel to bit2, for example. At this time, "0, 0, 1, 1" are stored in bit0-bit3, which is the expansion region of the SL channel. In addition, the audio signal processing unit 17 sets the reference bit position of the audio signal of the SR channel to bit1, for example. At this time, "0, 1, 1, 1" are stored in bit0-bit3, which is the expansion region of the SR channel.

The AV receiver 2 determines the FL channel in which "0, 0, 0, 0" are stored in bit0-bit3, which is the expansion region, to be the first channel. In addition, the AV receiver 2 determines the channel in which "0, 0, 0, 1" are stored in bit0-bit3, which is the expansion region, to be the FR channel. Further, the AV receiver 2 determines the channel in which "0, 0, 1, 1" are stored in bit0-bit3, which is the expansion region, to be the SL channel. Further, the AV receiver 2 determines the channel in which "0, 1, 1, 1" are stored in bit0-bit3, which is the expansion region, to be the SR channel.

In this manner, the AV receiver 2 can identify the four channels in accordance with the data stored in the expansion region, regardless of the order in which the four channels are arranged. In this example, the AV receiver 2 determines the FL channel, in which "0" is stored in the expansion region (bit0-bit3), to be the first channel.

The PC 1 can store a "1" in the reference bit position of each channel, and then carry out outputting. The audio signal extraction unit 271 of the AV receiver 2 determines the channel based on the reference bit position. For example, if "1" is stored in the reference bit position (bit4) and "0" is stored in bit3-bit0, the AV receiver 2 determines the channel of this sample to be the FL channel. Further, if "1" is stored in bit3 and "0" is stored in bit2-bit0, the AV receiver 2 determines the channel of this sample to be the SL channel. Further, if "1" is stored in bit2 and "0" is stored in bit1 and bit0, the AV receiver 2 determines the channel of this sample to be the FR channel. Moreover if "1" is stored in bit1 and "0" is stored in bit0, the AV receiver 2 determines the channel of this sample to be the SR channel.

Further, the AV receiver 2 can set a portion of the audio signal stored in the expansion region, or the amount of delay in accordance with the reference bit position in which "1" is stored.

For example, if bit0-bit3 of the sample are "0, 0, 0, 0" or the reference bit position in which "1" is stored is bit4, the CPU 22 of the AV receiver 2 sets the parameter of the delay to be applied to the audio signal of that channel to 0 ms (no delay). For example, if bit0-bit3 of the sample are "0, 0, 0, 1" or the reference bit position in which "1" is stored is bit3, the CPU 22 sets the parameter of the delay to be applied to the audio signal of that channel to 100 ms. For example, if bit0-bit3 of the sample are "0, 0, 1, 1" or the reference bit position in which "1" is stored is bit2, the CPU 22 sets the parameter of the delay to be applied to the audio signal of that channel to 200 ms. For example, if bit0-bit3 of the sample are "0, 1, 1, 1" or the reference bit position in which "1" is stored is bit1, the CPU 22 sets the parameter of the delay to be applied to the audio signal of that channel to 300 ms.

Since the PC 1 arranges the reference bit positions of the audio signals of all the channels in different positions from each other, it is possible to output an output signal with which the channels can be identified. Further, since the AV receiver 2 sets a portion of the audio signal data stored in the expansion region, or the effector parameter in accordance with the reference bit position, it is possible to set the effector parameter at the same time as receiving the audio signal, even if an effector parameter is not separately received.

An example will be described in which the PC 1 outputs an output signal to the AV receiver 2, on the condition that the output signal predetermined between the PC 1 and the AV receiver 2 is composed of the FL channel, the SR channel, the FR channel, and the SL channel, in that order. In the example described herein, the number of bits moved (shifted) of the sample data of each channel is used as the effector parameter.

In the example described herein, a case in which the number of bits to be shifted downward is not limited (determined) for each channel, but rather is changed by the PC 1 in the middle of a song, for example, will be described.

As shown in FIG. 17, the audio signal processing unit 17 does not shift the audio signal of the FL channel. For example, the audio signal processing unit 17 shifts the audio signal of the FR channel down one bit. Further, for example, the audio signal processing unit 17 shifts the audio signal of the SL channel down two bits. Further, for example, the audio signal processing unit 17 shifts the audio signal of the SR channel down three bits. The number of bits to shift each channel is not fixed (limited) to the foregoing.

The PC 1 outputs the output signal shifted downward by the desired number of bits for each channel to the AV receiver 2. The AV receiver 2 knows the order of the channels of the output signal and thus does not need to identify the channels. Since the order of the channels included in the output signal is determined in advance between the PC 1 and the AV receiver 2, the PC 1 can generate an output signal including two or more channels in which the number of bits to shift is the same.

For example, if the number of shifted bits is 0, the CPU 22 of the AV receiver 2 sets the parameter of the delay to be applied to the audio signal of that channel to 0 ms (no delay). For example, if the number of shifted bits is 1, the CPU 22 sets the parameter of the delay to be applied to the audio signal of that channel to 100 ms. For example, if the number of shifted bits is 2, the CPU 22 sets the parameter of the delay to be applied to the audio signal of that channel to 200 ms. For example, if the number of shifted bits is 3, the CPU 22 sets the parameter of the delay to be applied to the audio signal of that channel to 300 ms.

In a state in which the order of the channels of the received output signal is known, the AV receiver 2 can set the delay corresponding to each channel in real time, even if the number of shifted bits of the audio signal of the channel has changed in the middle of a song.

Since the AV receiver 2 detects that the first channel is the FL channel the audio signal of the FL channel is not shifted.

Modified Example 5

Figure 18:
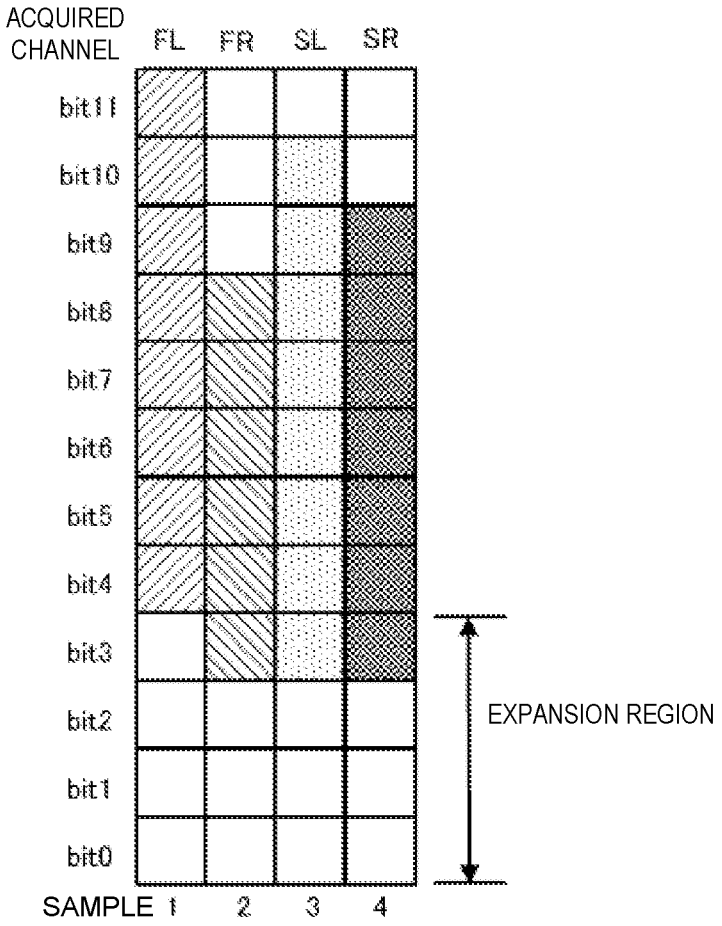
FIG. 18 is an explanatory diagram illustrating one example of an output signal according to Modified Example 5.

An output signal output by the PC 1 of Modified Example 5 will be described with reference to FIG. 18. FIG. 18 is an explanatory diagram illustrating one example of an output signal according to Modified Example 5. In FIG. 18, the horizontal axis represents samples (time) and the vertical axis represents bits (volume).

Here, an example will be described in which the PC 1 outputs an output signal to the AV receiver on the condition that the output signal predetermined between the PC 1 and the AV receiver 2 is composed of the FL channel, the FR channel, the SL channel, and the SR channel, in that order.

As shown in FIG. 18, the audio signal processing unit 17 generates an output signal such that the reference bit position of one of the four channels is different from the reference bit positions of the other channels. For example, the audio signal processing unit 17 arranges the reference bit position of the FL channel in a different position than the reference bit positions of the FR channel, the SL channel, and the SR channel. In this case, the audio signal processing unit 17 shifts each of the audio signal of the FR channel, the audio signal of the SL channel, and the audio signal of the SR channel down one bit such that the reference bit positions of the audio signal of the FR channel, the audio signal of the SL channel, and the audio signal of the SR channel becomes bit3.

The audio signal extraction unit 271 identifies the FL channel from the received output signal. In this case, the audio signal extraction unit 271 identifies the FL channel based on whether the bit3 value of the sample of the output signal is "0" or "1." The audio signal extraction unit 271 assumes that the FL channel, the FR channel, the SL channel, and the SR channel are arranged in this order, and extracts the next sample data after the FL channel as the FR channel. Similarly, the audio signal extraction unit 271 extracts the audio signal of each of the SL channel and the SR channel.

If a "0" is stored in the reference bit position of the FR channel, the SL channel, or the SR channel, it becomes difficult for the audio signal extraction unit 271 to identify the FL channel. Therefore, the audio signal processing unit 17 preferably outputs an output signal in which "1" is always stored in the reference bit positions of the FR channel, the SL channel, and the SR channel.

In this manner, the AV receiver 2 according to Modified Example 5 identifies one channel whose reference bit position is different from those of the other channels, and identifies the channels of the subsequent samples using the identified channel as the first channel. As a result, the AV receiver 2 according to Modified Example 5 can extract the audio signal of each of the four channels.

If the data stored in the expansion region are to be used as a delay, the AV receiver 2 can carry out a process to change the values of the reference bit positions of the sample of the FR channel, the samples of the SL channel and the SR channel to "0" so that all can be set to the same delay.

Modified Example 6

Figure 19:
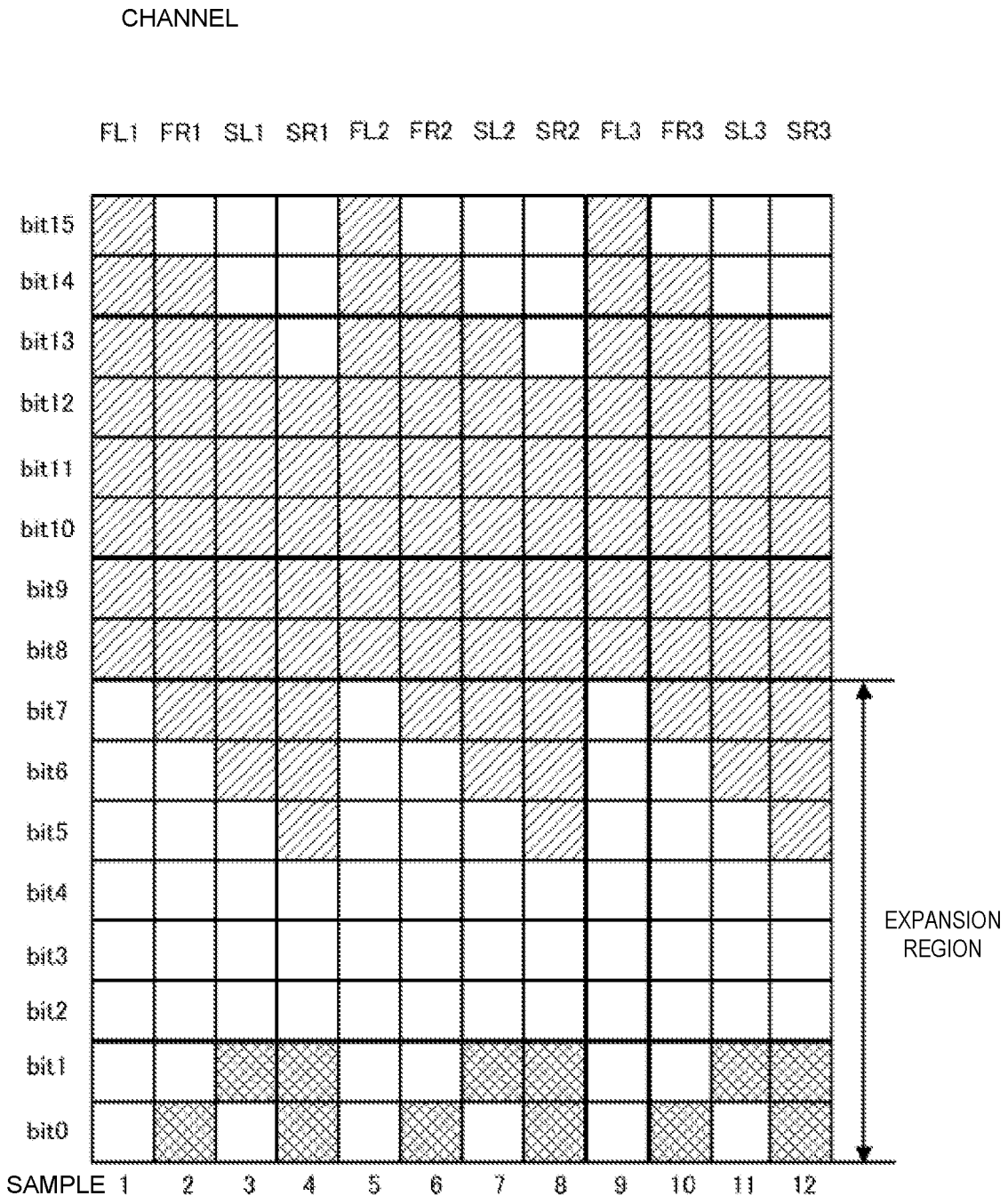
FIG. 19 is an explanatory diagram illustrating one example of an output signal according to Modified Example 6.

An output signal output by the PC 1 of Modified Example 6 will be described with reference to FIG. 19. FIG. 19 is an explanatory diagram illustrating one example of an output signal according to Modified Example 6. In FIG. 19, the horizontal axis represents samples (time) and the vertical axis represents bits (volume). Further, in this example, an audio signal in which the number of quantization bits of the audio signal of each channel before expansion is 8 (bits), and which has been expanded to 16 bits by adding 8 bits to these 8 bits, will be described.

The audio signal processing unit 17 stores data that make it possible to identify four channels in the expansion region of each of the audio signals.

As shown in FIG. 19, the audio signal processing unit 17 uses the lower two bits (bit0 and bit1) in the 8 bits of the expansion region to store the data for identifying each channel. For example, the audio signal processing unit 17 stores "0" in bit0 and bit1 of the sample of the FL channel. Further, for example, the audio signal processing unit 17 stores "1" in bit0 and stores "0" in bit1 of the sample of the FR channel. Further, the audio signal processing unit 17 stores "0" in bit0 and stores "1" in bit1 of the sample of the SL channel. In addition, for example, the audio signal processing unit 17 stores "1" in both bit0 and bit1 of the sample of the SR channel.

Further, the audio signal processing unit 17 can store the signal processing parameter MD corresponding to the audio signal in bit2 and bit3 of the expansion region.

In this manner, the PC 1 can store data indicating the channel in the expansion region in order to output an output signal with which the channels can be identified. In addition, since the PC 1 can specify the channel with only one sample of the output signal, it is possible to generate an output signal that shortens the decoding time of the AV receiver 2.

The data indicating the channel and the signal processing parameter MD are stored in the lower bits (expansion region) of the audio signal. If a playback device different from that of the present embodiment reproduces the audio signal as is, without carrying out a process such as channel extraction, the lower bits would also be treated as audio data, which produces noise. However, even if the playback device were to generate the audio signals as is, lower bit data have little effect on volume. Therefore, by using the output signal shown in FIG. 19, the sensory noise level is reduced.

Further, the AV receiver 2A or the AV receiver 2Aa has the parameter extraction unit 272. Therefore, the AV receiver 2A or the AV receiver 2Aa can extract the signal processing parameter MD stored in the expansion region separately from the audio signal. As a result, when the AV receiver 2A or the AV receiver 2Aa carries out the reproduction, noise will not be generated.

Another Example of Downmix

Figure 20:
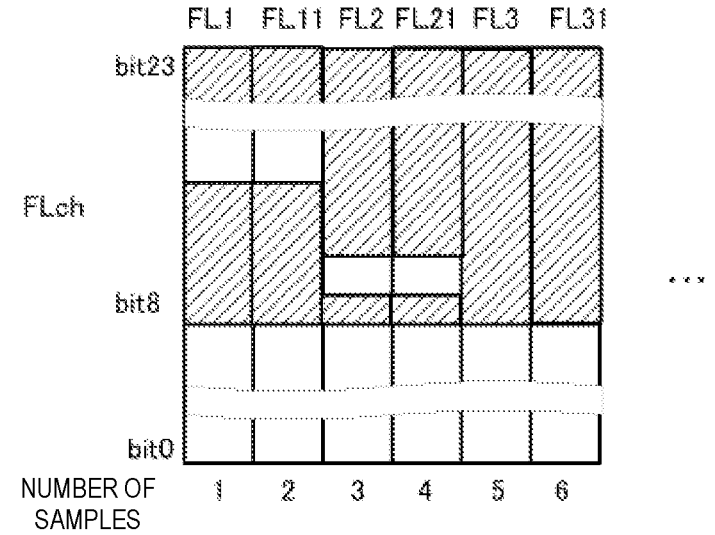
FIG. 20 is an explanatory diagram illustrating one example in which the FL channel and the FR channel have been upsampled.
Figure 20:
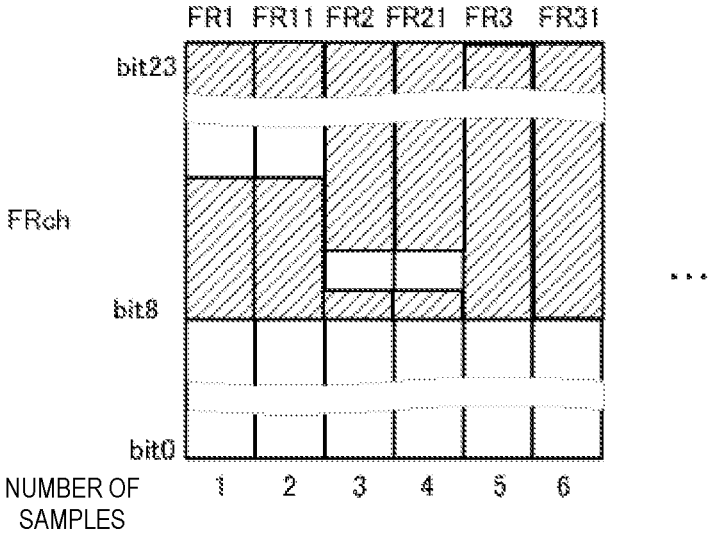

Another example of downmix will be described with reference to FIG. 20. FIG. 20 is an explanatory diagram illustrating one example in which the FL channel and the FR channel have been upsampled. In FIG. 20, the horizontal axis of each channel represents samples (time) and the vertical axis represents bits (volume).

The audio signal processing unit 17 upsamples the FL channel and the FR channel. That is, the audio signal processing unit 17 doubles the sampling frequencies of the FL channel and the FR channel. As shown in FIG. 20, the audio signal processing unit 17 stores the same sample data in the FL1 sample and the FL11 sample. In addition, the audio signal processing unit 17 stores the same sample data in the FL2 sample and the FL21 sample. Moreover, the audio signal processing unit 17 stores the same sample data in the FL3 sample and the FL31 sample.

The audio signal processing unit 17 carries out the similar process on the FR channel as on the FL channel.

The audio signal processing unit 17 stores the sample data of the SL1 sample, the sample data of the SL2 sample, and the sample data of the SL3 sample of the SL channel, in the even-numbered samples of the FL channel (FL11 sample, FL21 sample, and FL31 sample). In addition, the audio signal processing unit 17 stores the sample data of the SR1 sample, the sample data of the SR2 sample, and the sample data of the SR3 sample of the SR channel, in the odd-numbered samples of the FR channel (FR11 sample, FR21 sample, and FR31 sample).

In this manner, the audio signal processing unit 17 stores the audio signal of the SL channel in the even-numbered samples of the FL channel in order to downmix the audio signal of the FL channel and the audio signal of the SL channel. Similarly, the audio signal processing unit 17 stores the audio signal of the SR channel in the even-numbered samples of the FR channel in order to downmix the audio signal of the FR channel and the audio signal of the SR channel.

It should be noted that, with regard to upsampling, the invention is not limited to the example in which the same data as in the odd-numbered samples are stored in the even-numbered samples of the FL channel and the FR channel. "0" can be stored in the even-numbered samples of the FL channel and the FR channel.

Figure 21:
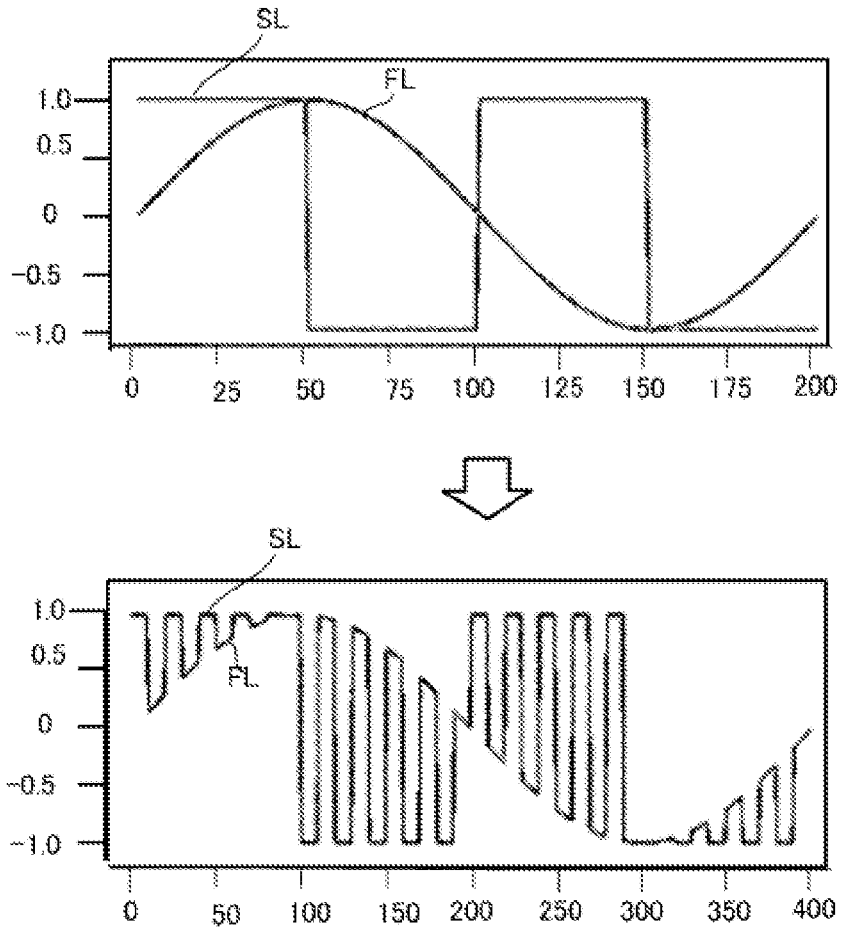
FIG. 21 is an explanatory diagram illustrating one example of a waveform obtained by downmixing two channels into one channel.

The waveform of the output signal output by the PC 1 is described with reference to FIG. 21. FIG. 21 is an explanatory diagram illustrating one example of a waveform obtained by downmixing two channels into one channel. In FIG. 21, the horizontal axis represents samples and the vertical axis represents volume.

In this example, a case in which downmixing is carried out by means of upsampling will be described using the FL channel and the SL channel as representative examples. In addition, in this example, the audio signal of the FL channel is the sine wave shown in FIG. 21, the audio signal of the SL channel is the square wave shown in FIG. 21, and the sampling frequency of each is 48 kHz, for example.

When the audio signal processing unit 17 upsamples and downmixes the FL channel, the downmixed waveform becomes a signal in which the audio signal of the FL channel and the audio signal of the SL channel are mixed, as shown in the lower part of FIG. 21. The sampling frequency at this time is 96 kHz.

In this manner, by upsampling and then downmixing a plurality of channels, the PC 1 can carry out the downmixing while maintaining the waveform of each channel. Even if a playback device that differs from that of the present embodiment reproduces the audio signal as is, without carrying out a process such as audio signal extraction of each of the plurality of channels, the user is able to listen to the sounds of both the SL channel and the FL channel. Therefore, the audio signal processing unit 17 can generate an output signal that can be reproduced like a multi-channel signal, even if the signal has been upsampled and downmixed.

Other Modified Examples

Modified examples other than Modified Examples 1 to 6 will be listed.

The PC 1 can, for example, expand the 16-bit quantized signal to 24 bits or more, for example, to 32 bits. In this case, the PC 1 can store even more information in the expansion region.

The format of the audio signal acquired by the PC 1 can be a speech audio signal in a lossless or a lossy format stored in the audio signal portion in a compressed audio format. If the audio signal acquired by the PC 1 is in a lossy format, the PC 1 can be configured to decode the audio signal in the lossy format and to convert it into an audio signal in a normal PCM (Pulse Code Modulation) speech format.

Further, the PC 1 can acquire five channels or more, or three channels or less. In addition, the PC 1 need only generate and output an output signal having a number of channels less than or equal to the number of acquired channels, regardless of the number of acquired channels. For example, the PC 1 can be configured to acquire audio signals of eight channels and output an output signal of two channels.

Further, in the case that the audio signal processing unit 17 of the PC 1 stores a "1" in the lowest bit (bit0) of the first channel and a "0" in the lowest bit (bit0) of the other channel, the AV receiver 2 can detect the value of bit0 of each sample of the output signal in order to identify the channels that constitute the output signal. For example, the AV receiver 2 determines the sample in which 1 is stored in the lowest bit to be the FL channel. As a result, the AV receiver 2 is able to identify the channel by means of the lowest bit, even if the audio signal of the channel has not been shifted down. In addition, in this case, the audio signal processing unit 17 of the PC 1 does not need to shift the audio signal in order to identify the channels. The audio signal processing unit 17 can use the number of bits to be shifted as a parameter for the effector of the audio signal. For example, if the number of shifted bits is 0, the CPU 22 of the AV receiver 2 sets the parameter of the delay to be applied to the audio signal of that channel to 0 ms (no delay). For example, if the number of shifted bits is 1, the CPU 22 sets the parameter of the delay to be applied to the audio signal of that channel to 100 ms. For example, if the number of shifted bits is 2, the CPU 22 sets the parameter of the delay to be applied to the audio signal of that channel to 200 ms. For example, if the number of shifted bits is 3, the CPU 22 sets the parameter of the delay to be applied to the audio signal of that channel to 300 ms.

Further, the output signal can be an analog signal, a digital signal, or in file format.

The description of the present embodiment has been presented as an example in all respects and should not be considered restrictive. The scope of the present invention is indicated by the Claims section, not the embodiment described above. Furthermore, the scope of the present invention is intended to include the scope that is equivalent that of the Claims, as well as all modifications that are within the scope.

What is claimed is:

1. An audio signal output device comprising:

an audio signal acquisition unit configured to acquire audio signals of a plurality of channels;

a first electronic controller including a quantization bit expansion unit configured to expand the number of quantization bits of each of the audio signals to generate an expansion region for each of the audio signals, such that each of the plurality of channels has the expansion region and a region in which a corresponding audio signal of the audio signals is stored, an audio signal processing unit configured to generate a downmixed output signal in which the plurality of channels are downmixed such that an audio signal of at least one channel from among the plurality of channels is arranged at a reference bit position that is a position for identifying the at least one channel and is different from a reference bit position for an audio signal of a different channel of the plurality of channels, and such that the reference bit position for the audio signal of the at least one channel is positioned within the expansion region of the at least one channel, the reference bit position for the audio signal of the different channel being a position for identifying the different channel; and an output interface configured to output an output signal based on the downmixed output signal.

2. The audio signal output device according to claim 1, wherein the audio signal processing unit is configured to arrange the audio signals of the plurality of channels in order.

3. The audio signal output device according to claim 1, wherein the audio signal processing unit is configured to upsample the audio signals of the plurality of channels.

4. The audio signal output device according to claim 1, wherein the plurality of channels are three or more channels, and the audio signal processing unit is configured to arrange reference bit positions of the audio signals of all of the plurality of channels to be downmixed, which include the reference bit position for the audio signal of the at least one channel and the reference bit position for the audio signal of the different channel, at positions that are different from each other, using the expansion region.

5. The audio signal output device according to claim 1, wherein the audio signal processing unit is configured to add a signal processing parameter of each of the audio signals in a different position than reference bit positions of the audio signals, which include the reference bit position for the audio signal of the at least one channel and the reference bit position for the audio signal of the different channel.

6. An audio system comprising:

the audio signal output device according to claim 1; and a reception device having a receiver configured to receive the output signal output by the audio signal output device, and a second electronic controller including an audio signal extraction unit configured to extract each of the audio signals of the plurality of channels in accordance with the number of the plurality of channels.

7. The audio system according to claim 6, wherein the second electronic controller further includes a channel number detection unit configured to detect the number of the plurality of channels based on reference bit positions of the audio signals of the plurality of channels, which include the reference bit position for the audio signal of the at least one channel and the reference bit position for the audio signal of the different channel, in the output signal.

8. The audio system according to claim 7, wherein the channel number detection unit is configured to detect the number of the plurality of channels, using the output signal of a prescribed number of samples.

9. The audio system according to claim 8, wherein the channel number detection unit is configured to assume a prescribed number of channels, set a prescribed period in accordance with the prescribed number of channels, determine whether the prescribed number of channels exists in the prescribed period, and reset the prescribed period based on a determination result.

10. The audio system according to claim 6, wherein the audio signal processing unit is configured to arrange reference bit positions of the audio signals of the plurality of channels, which include the reference bit position for the audio signal of the at least one channel and the reference bit position for the audio signal of the different channel, at a predetermined position, and the second electronic controller further includes a parameter extraction unit configured to extract a signal processing parameter of each of the audio signals based on data of the reference bit positions of the audio signals of the plurality of channels.

11. The audio system according to claim 6, wherein the audio signal extraction unit is configured to downsample the audio signals upon determining that the audio signals have been upsampled.

12. An audio signal output method comprising:

acquiring audio signals of a plurality of channels;

expanding the number of quantization bits of each of the audio signals to generate an expansion region for each of the audio signals, such that each of the plurality of channels has the expansion region and a region in which a corresponding audio signal of the audio signals is stored;

generating a downmixed output signal in which the plurality of channels are downmixed such that an audio signal of at least one channel from among the plurality of channels is arranged at a reference bit position that is a position for identifying the at least one channel and is different from a reference bit position for an audio signal of a different channel of the plurality of channels, and such that the reference bit position for the audio signal of the at least one channel is positioned within the expansion region of the at least one channel, the reference bit position for the audio signal of the different channel being a position for identifying the different channel; and outputting an output signal based on the downmixed output signal.

13. The audio signal output method according to claim 12, wherein in the generating of the output signal, the audio signals of the plurality of channels are arranged in order.

14. The audio signal output method according to claim 12, wherein in the generating of the output signal, the audio signals of the plurality of channels are upsampled.

15. The audio signal output method according to claim 12, wherein the plurality of channels are three or more channels, and in the generating of the output signal, reference bit positions of the audio signals of all of the plurality of channels to be downmixed, which include the reference bit position for the audio signal of the at least one channel and the reference bit position for the audio signal of the different channel, are arranged in different positions from each other, using the expansion region.

16. The audio signal output method according to claim 12, wherein in the generating of the output signal, a signal processing parameter of each of the audio signals is added in a different position than reference bit positions of the audio signals, which include the reference bit position for the audio signal of the at least one channel and the reference bit position for the audio signal of the different channel.

* * * * *